US011503910B1

(12) United States Patent
Carmen

(10) Patent No.: US 11,503,910 B1
(45) Date of Patent: Nov. 22, 2022

(54) MODULAR ORGANIZER SYSTEM

(71) Applicant: Nicholas Edward Carscallen Carmen, Los Angeles, CA (US)

(72) Inventor: Nicholas Edward Carscallen Carmen, Los Angeles, CA (US)

( * ) Notice: Subject to any disclaimer, the term of this patent is extended or adjusted under 35 U.S.C. 154(b) by 258 days.

(21) Appl. No.: 16/893,293

(22) Filed: Jun. 4, 2020

Related U.S. Application Data

(60) Provisional application No. 62/857,688, filed on Jun. 5, 2019.

(51) Int. Cl.

| | |
|---|---|
| ***A47B 88/975*** | (2017.01) |
| ***A47G 21/14*** | (2006.01) |
| ***A47B 88/988*** | (2017.01) |
| ***A47B 88/994*** | (2017.01) |

(52) U.S. Cl.
CPC ..... *A47B 88/975* (2017.01); *A47B 88/988* (2017.01); *A47B 88/994* (2017.01); *A47G 21/14* (2013.01)

(58) Field of Classification Search
CPC ... A47B 88/969; A47B 88/975; A47B 88/988; A47B 88/994; A47B 2088/202; A47B 2088/205; A47B 2088/976; A47B 77/14; A47B 77/18; A47G 21/14
See application file for complete search history.

(56) References Cited

U.S. PATENT DOCUMENTS

| | | | | |
|---|---|---|---|---|
| 2,315,595 | A * | 4/1943 | Chappory | A47F 5/13 211/186 |
| 2,640,621 | A * | 6/1953 | Mokin | A47B 88/90 217/7 |
| 2,889,924 | A * | 6/1959 | Paulucci | F25D 25/022 211/49.1 |
| 3,343,706 | A | 9/1967 | Berend | |
| 3,501,020 | A * | 3/1970 | Krikorian | A47F 5/005 211/184 |
| 3,710,900 | A | 1/1973 | Fink | |
| 4,305,629 | A | 12/1981 | Friis | |
| 4,595,246 | A | 6/1986 | Bross | |
| 4,807,760 | A | 2/1989 | Sussman | |
| 5,242,223 | A | 9/1993 | Koves | |
| 5,553,710 | A | 9/1996 | Takama | |
| 5,664,691 | A | 9/1997 | Boivin-Paradis | |
| 5,738,425 | A | 4/1998 | Rosenberg et al. | |
| 6,073,794 | A | 6/2000 | Bidot | |
| 6,357,844 | B1 | 3/2002 | Muterthies et al. | |
| 6,467,622 | B1 | 10/2002 | Hull | |
| 6,493,917 | B1 | 12/2002 | Sunka | |
| 6,695,419 | B2 | 2/2004 | Searer et al. | |
| 6,913,164 | B2 | 7/2005 | Duquette | |

(Continued)

*Primary Examiner* — Andrew M Roersma
(74) *Attorney, Agent, or Firm* — Michael O'Brien, Esq; Jack Fritz, Esq

(57) ABSTRACT

A modular organizer system is configured to sort and store items. The modular organizer system has a first rail assembly with a first sidewall further comprising a first sidewall upper member joined to a first sidewall lower member with a first plurality of upright support members. A second rail assembly has a second sidewall, proximate the first sidewall with a second sidewall upper member joined to a second sidewall lower member with a second plurality of upright support members. A segregated storage space exists between the first sidewall and the second sidewall.

19 Claims, 23 Drawing Sheets

(56) References Cited

U.S. PATENT DOCUMENTS

| | | | | |
|---|---|---|---|---|
| 6,991,307 | B2 | 1/2006 | Hoenig | |
| 7,380,894 | B2 * | 6/2008 | Berger | A47B 88/994 312/348.3 |
| 9,351,590 | B1 * | 5/2016 | Wildrick | A47B 57/588 |
| 2004/0245254 | A1 | 12/2004 | Rosenberg et al. | |
| 2008/0083753 | A1 | 4/2008 | Escobar et al. | |
| 2008/0105589 | A1 | 5/2008 | Armstrong | |
| 2008/0202976 | A1 | 8/2008 | Burgess et al. | |
| 2008/0258593 | A1 * | 10/2008 | Berger | A47B 88/994 312/348.3 |
| 2009/0045708 | A1 | 2/2009 | Dominique | |
| 2011/0084584 | A1 | 4/2011 | Curtin | |

* cited by examiner

FIG. 9A
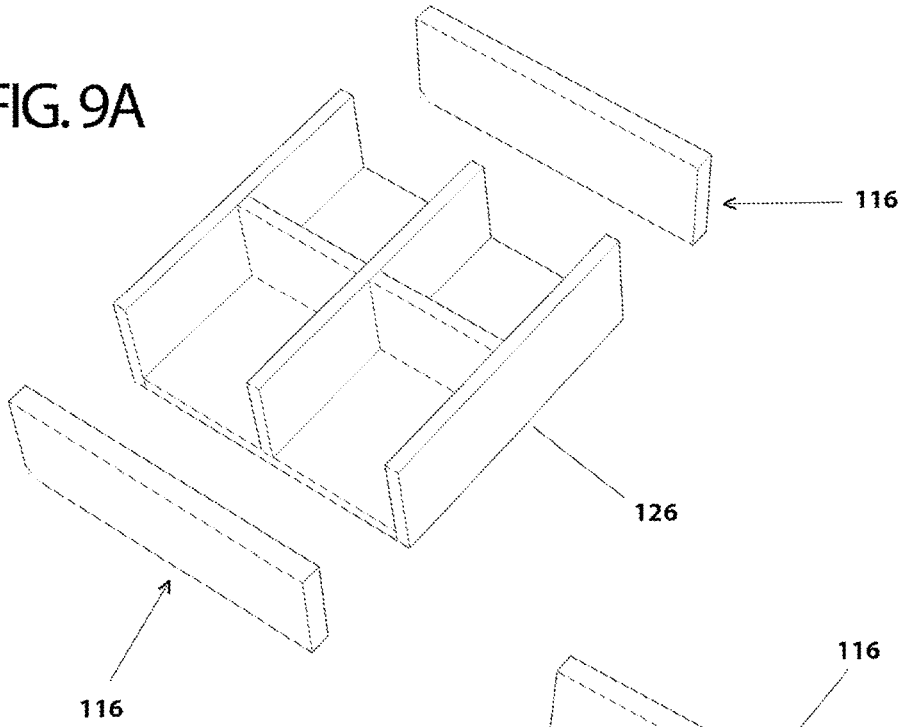
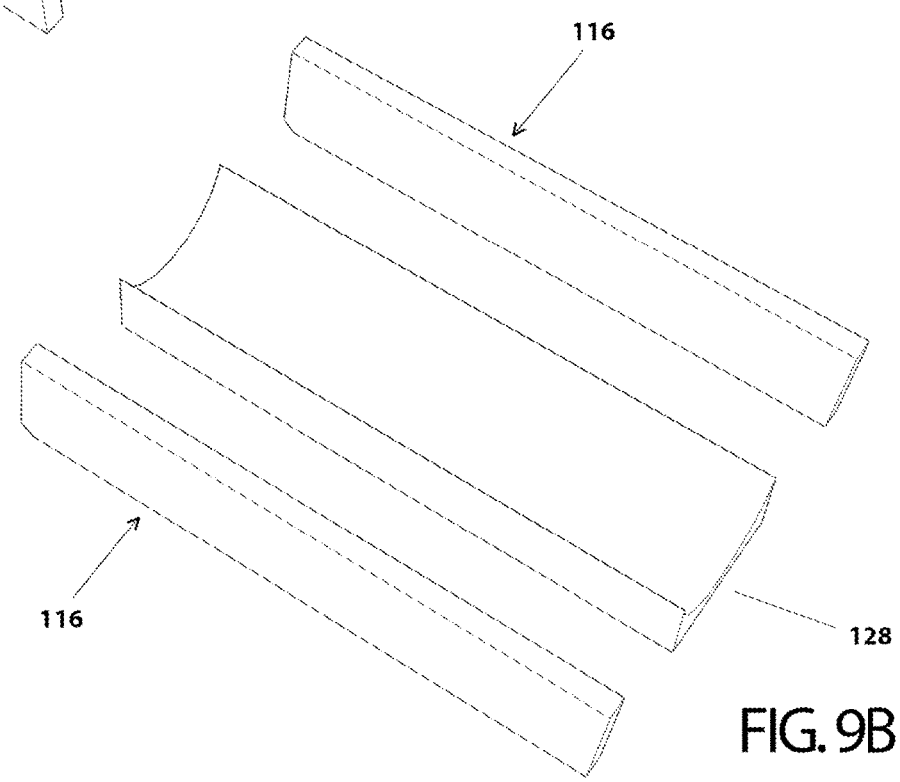
FIG. 9B

FIG. 11A
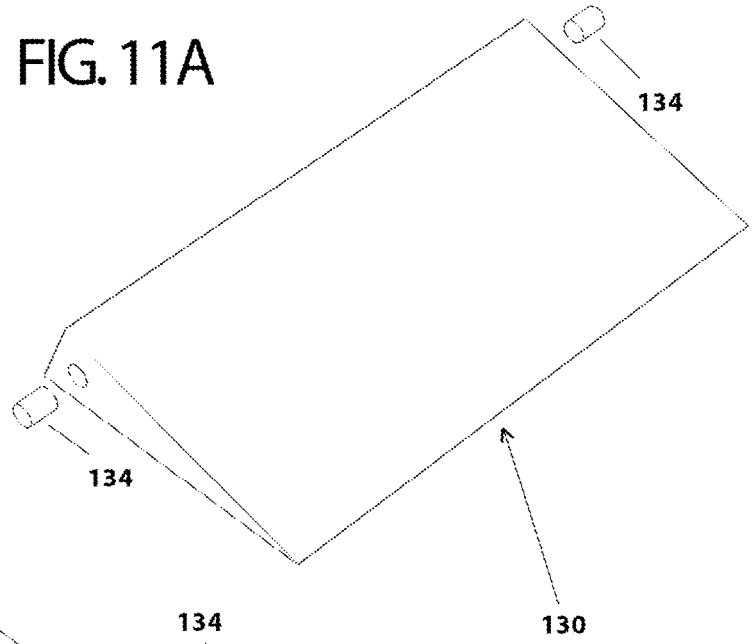
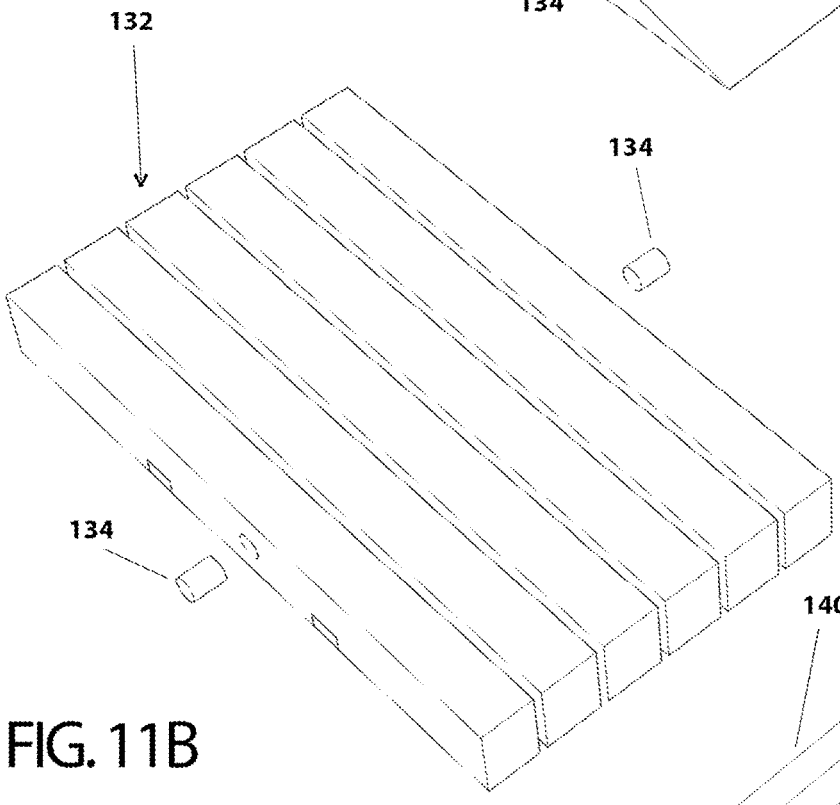
FIG. 11B
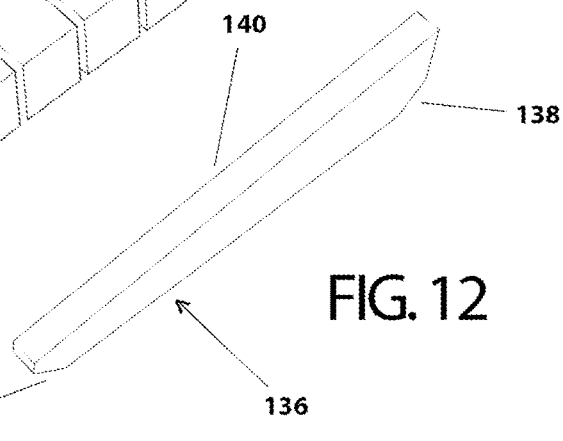
FIG. 12

MODULAR ORGANIZER SYSTEM

RELATED APPLICATION

This application claims priority to provisional patent application U.S. Ser. No. 62/857,688 filed on Jun. 5, 2019, the entire contents of which is herein incorporated by reference.

BACKGROUND

Organizers come in a variety of sizes and configurations and are commonly used to store items in a separate enclosure (e.g. a drawer). The efficient organization of various articles within a drawer, whether they are tools, cutlery, utensils, hardware, toiletries, stationary, sundries, or other items, has long presented a problem.

One attempt to address the problem has been the use of boxes positioned within a drawer. However, boxes come in set shapes and sizes that may not accommodate various individual items or effectively utilize the entire drawer area, resulting in wasted space. Individual boxes may also slide around and become disorganized when the drawer is open or closed, requiring constant readjustment and positioning.

Another approach has been to use box-like structures that are cut to fit precisely within the drawer. Many users do not want to bother with tools required for cutting or have difficulty making accurate cuts necessary to provide a precise fit. Moreover, once the box-like structure is cut, it will not precisely fit another drawer with different dimensions and cannot be altered to provide a different arrangement in the same drawer.

Another approach is the use of expanding trays. One shortcoming of these devices is that the configuration of the trays is fixed and inflexible so the compartments cannot be rearranged or adjusted to suit the needs of the user. They are also limited in expansion to a minimum and maximum deployable length, which may not effectively utilize the entire drawer area. Additionally, I have found the use of a base tray, which sits on the floor of the enclosure, takes up valuable space in shallow drawers and reduces the usefulness of the organizer. I have also found that the base tray substantially obscures part of the drawer, altering the aesthetic appearance of the enclosure in a way the user may find undesirable.

SUMMARY

A device for organization of items within an enclosure that overcomes the collective disadvantages posed by each of the above approaches would be of great advantage to the user. Thus, the present invention recognizes a long-felt need to increase versatility and adjustability of such types of organizers so that it can accommodate various sized drawers and organize items of varying size and shape.

A modular organizer system is configured to sort and store items. The modular organizer system comprises a first rail assembly further comprising a first sidewall further comprising a first sidewall upper member joined to a first sidewall lower member with a first plurality of upright support members.

A second rail assembly further comprises a second sidewall proximate the first sidewall and further comprising a second sidewall upper member joined to a second sidewall lower member with a second plurality of upright support members. A segregated storage space exists between the first sidewall and the second sidewall.

A first sidewall perpendicular cross member can be joined to the first sidewall bottom first lower member and configured to support the first sidewall upright. A second sidewall perpendicular cross member can be joined to the second sidewall bottom first lower member and configured to support the second sidewall upright. A tube member can be arranged over the first sidewall perpendicular cross member and the second sidewall perpendicular cross member and connecting the first sidewall to the second sidewall.

A first sidewall perpendicular cross tube can be joined to the first sidewall bottom first lower member and configured to support the first sidewall upright. A second sidewall perpendicular cross tube can be joined to the second sidewall bottom first lower member and configured to support the second sidewall upright. A bar member can be arranged into the first sidewall perpendicular cross tube and the second sidewall perpendicular cross tube and connecting the first sidewall to the second sidewall.

A first sidewall second lower member can be joined to the first plurality of upright support members and configured to further support the first sidewall. A second sidewall second lower member can be joined to the second plurality of upright support members and configured to further support the second sidewall.

A first sidewall upper member male threaded member can be arranged on a first sidewall upper member first end of the first sidewall upper member. A first sidewall upper member female threaded cap can be threaded onto the first sidewall upper member male threaded member. Adjusting the first sidewall upper member female threaded cap adjusts a first sidewall upper member length. A second sidewall upper member male threaded member can be arranged on a second sidewall upper member first end of the second sidewall upper member. A second sidewall upper member female threaded cap can be threaded onto the second sidewall upper member male threaded member. Adjusting the second sidewall upper member female threaded cap adjusts a second sidewall upper member length.

A divider can be arranged between a first sidewall first set of support members and a second sidewall first set of support members. The divider further comprises a top side that can connect a first angled side and a second angled side. A bottom side can connect the first angled side and the second angled side. A notch can be arranged from the first angled side to the bottom side. A tip can be arranged at a corner formed by the top side and the second angled side. The first angled side can be approximately parallel to the second angled side. The notch can rest against the first sidewall first lower member and the tip extends beneath the second sidewall upper member.

A second divider can be arranged between a first sidewall second set of support members and a second sidewall second set of support members. An accessory can be arranged between the first divider and the second divider.

A third rail assembly can further comprise a third sidewall further comprising a third sidewall upper member joined to a third sidewall lower member with a third plurality of upright support members. A third divider can be arranged between the second sidewall first set of support members and the third sidewall first set of support members. The third rail assembly extends the width of the modular organizer system. The second angled side of the first divider can be immediately adjacent to the first angled side of the third divider.

An accessory can be arranged within the segregated storage space. The accessory can have a shape selected from one member of a shape set consisting of a box shape, a bowl shape, a wedge shape and a knife block. Another accessory can further comprise a first peg and a second peg; wherein the first peg fits between the first sidewall first set of support members and the second peg fits between the second sidewall first set of support members.

The first sidewall can further comprise a first sidewall female support tube and a first sidewall male support protrusion. A first sidewall rail extender can further comprise a first sidewall rail extender male support protrusion and a first sidewall rail extender female support tube. The first sidewall female support tube can slide over the first sidewall rail extender male support protrusion to connect the first sidewall to the first sidewall rail extender.

In some embodiments, the first sidewall can further comprise a first sidewall upper member protrusion and a first sidewall lower member protrusion and a first sidewall rail extender can further comprise a first sidewall rail extender upper member tube and a first sidewall rail extender lower member tube. The first sidewall rail extender lower member tube can slide over the first sidewall lower member protrusion to connect the first sidewall to the first sidewall rail extender. The first sidewall rail extender upper member tube can slide over the first sidewall upper member protrusion to connect the first sidewall to the first sidewall rail extender.

In some embodiments, a first sidewall rail extender can further comprise a first sidewall rail extender upper member and a first sidewall rail extender lower member. A first sidewall upper magnet can be joined to the first sidewall upper member. A first sidewall lower magnet can be joined to the first sidewall lower member. A first sidewall rail extender upper member upper magnet can be joined to the first sidewall rail extender upper member. A first sidewall rail extender lower member lower magnet can joined to the first sidewall rail extender lower member. The first sidewall upper magnet can be magnetically coupled to the first sidewall rail extender upper member upper magnet and the first sidewall lower magnet can be magnetically coupled to the first sidewall rail extender lower member lower magnet to magnetically couple the first sidewall to the first sidewall rail extender.

The disclosed modular organizer system can be useful in any enclosed space (e.g. a drawer in kitchens, bathrooms, offices, desks, closets, dressers, etc.) to organize a plurality of items of various sizes and shapes (e.g. cutlery, utensils, tools, hardware, clothing, office supplies, toiletries, make-up, stationary, sundries, etc.).

It is an object of the present invention to create adjustable spaces inside an enclosed space, such as a drawer, to accommodate multiple items of varying size and shape. It is another object of the present invention to create adjustable spaces that accommodate the width and length of the enclosed space.

Advantages

Accordingly several advantages of one or more aspects are as follows: to provide an organizer that is adjustable, that is reconfigurable before and after installation, that can organize various sized items, that can be combined to effectively utilize the drawer area, that can be secured in place within the drawer, that does not require tools to install, that is easy to set up, that does not substantially obscure or alter the appearance of the drawer when installed, that maintains a neat and uniform appearance when combined and installed, that doesn't obscure items placed within, and that does not take up space in shallow enclosures.

BRIEF DESCRIPTION OF THE FIGURES

The detailed description of some embodiments of the invention is made below with reference to the accompanying figures, wherein like numerals represent corresponding parts of the figures.

FIG. 9A shows one type of accessory that can be secured to the rail assembly between dividers.

FIG. 9B shows one type of accessory that can be secured to the rail assembly between dividers.

FIG. 11A shows one type of accessory that can be secured to the rail assembly with pegs.

FIG. 11B shows one type of accessory that can be secured to the rail assembly with pegs.

FIG. 12 shows one type of accessory that can be secured to the rail assembly in a manner similar to the dividers.

DETAILED DESCRIPTION OF CERTAIN EMBODIMENTS

Figure 1:
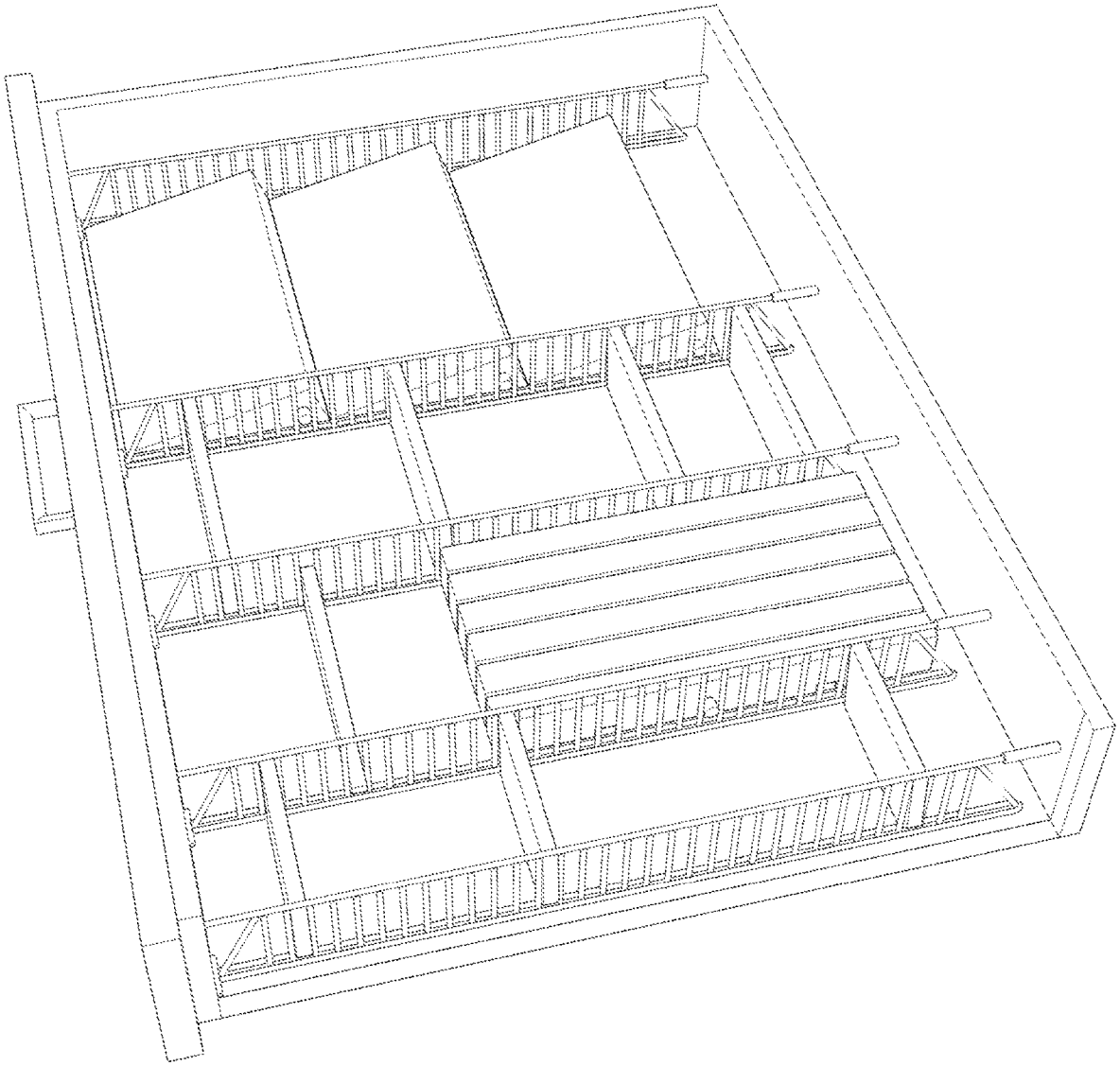
FIG. 1 is a perspective view of the modular organizer system, constructed in one possible configuration in accordance with the teachings of the present invention, showing it in operation within a drawer.

FIG. 1. generally illustrates one embodiment a modular organizer system constructed in accordance with the teachings of the present invention, shown in operation within a drawer. The modular organizer system generally has a number of basic components, including an adjustable rail assembly, separate dividers, and a suite of separate accessories.

Figure 2:
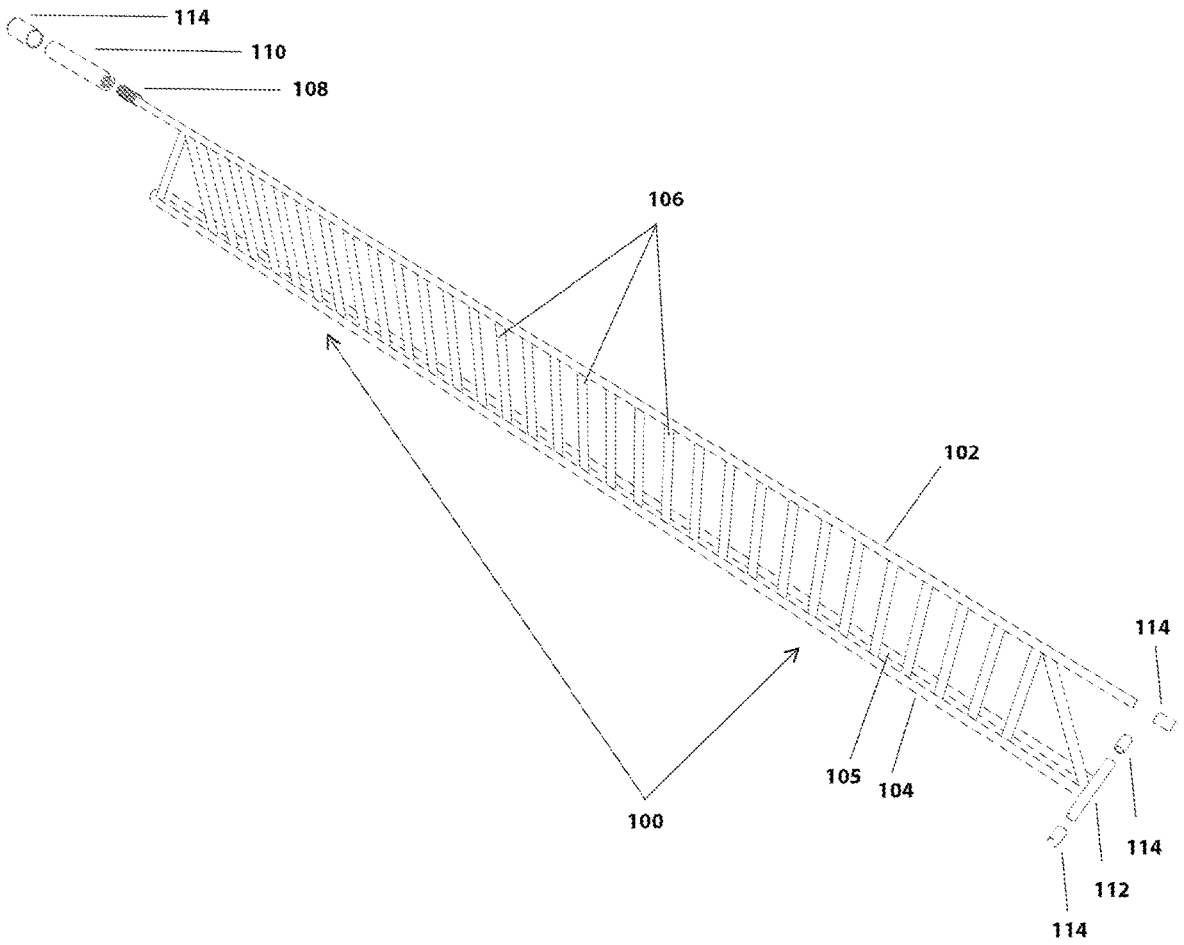
FIG. 2 is a perspective view of the rail assembly and its multiple components.

FIG. 2 illustrates one embodiment of a rail assembly. The rail assembly is composed of a sidewall 100 without a tray bottom or base. This allows the device to be installed without significantly obscuring or altering the appearance of an enclosure. It also does not take up valuable space in shallow drawers. The sidewall 100 has an upper member 102 and one or more lower members 104 and 105, which are connected by a plurality of upright support members 106 that are spaced a consistent distance apart from each other. One advantage of the support members is the ability for the user to see into the device from any angle, making it easy to find various items stored within. The end of the upper member 102 is threaded to form a male threaded member 108 over which a female threaded cap 110 may be screwed on and adjusted for length to fit the rail assembly within a drawer. At the end of the lower members 104 and 105 is a cross member 112 which provides stability and allows the user to position the rail assembly perpendicular to the inside edge of an enclosure. The cross member 112 aligns flush to the end of the upper member 102 creating multiple points of contact with the front of an enclosure. Bumpers 114 may be placed at the end of the upper member 102, the ends of the cross member 112, and the back of the threaded cap 110 to provide extra grip for an even more secure fit. Rail assemblies may come in virtually any length, with any number of support members 106 between the upper member 102 and lower members 104 and 105.

In one embodiment the rail assembly may be made out of steel wire such as basic bright, galvanized, or stainless. The wire may be attached together by welding (MIG or TIG). A wire gauge of 9 through 11 or 3 mm through 5 mm may be used for parts of the assembly and a corresponding thread size (6-32 through 10-32 or m3 through m5) may be employed for the threaded member and threaded cap.

Figure 3A:
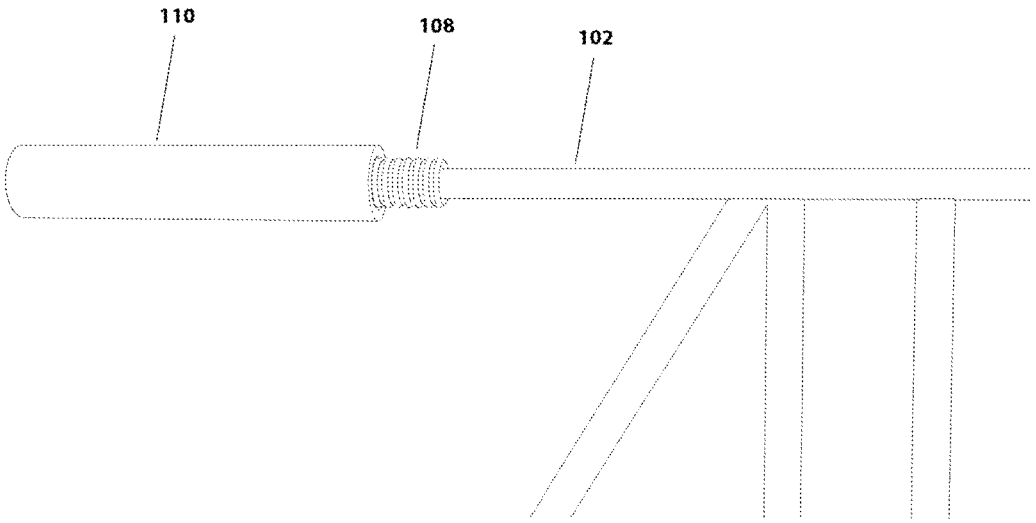
FIG. 3A is an enlarged view of the back of a rail assembly, highlighting the threaded member and threaded cap.
Figure 3B:
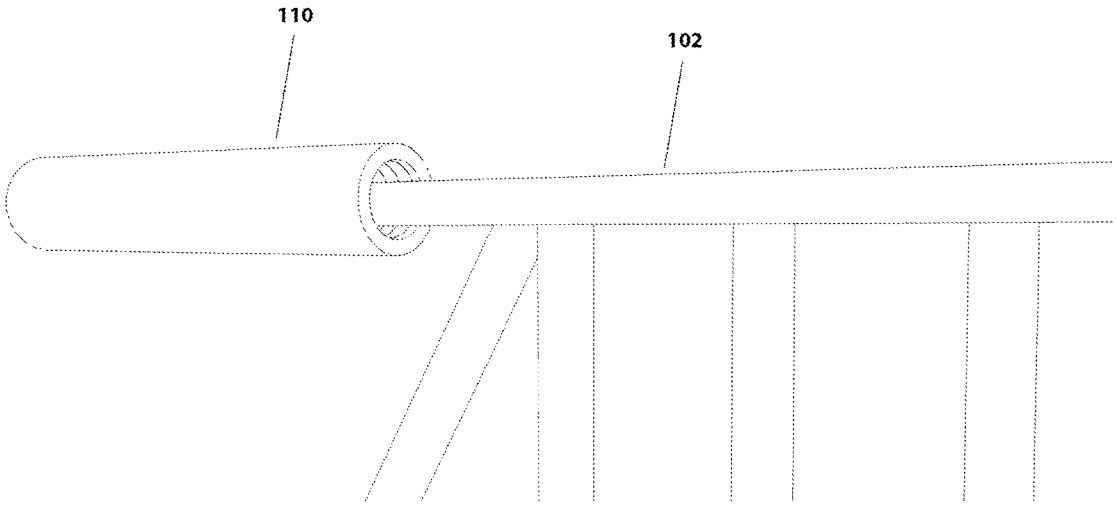
FIG. 3B is an enlarged view of the back of a rail assembly, highlighting the upper member and threaded cap.
Figure 4:
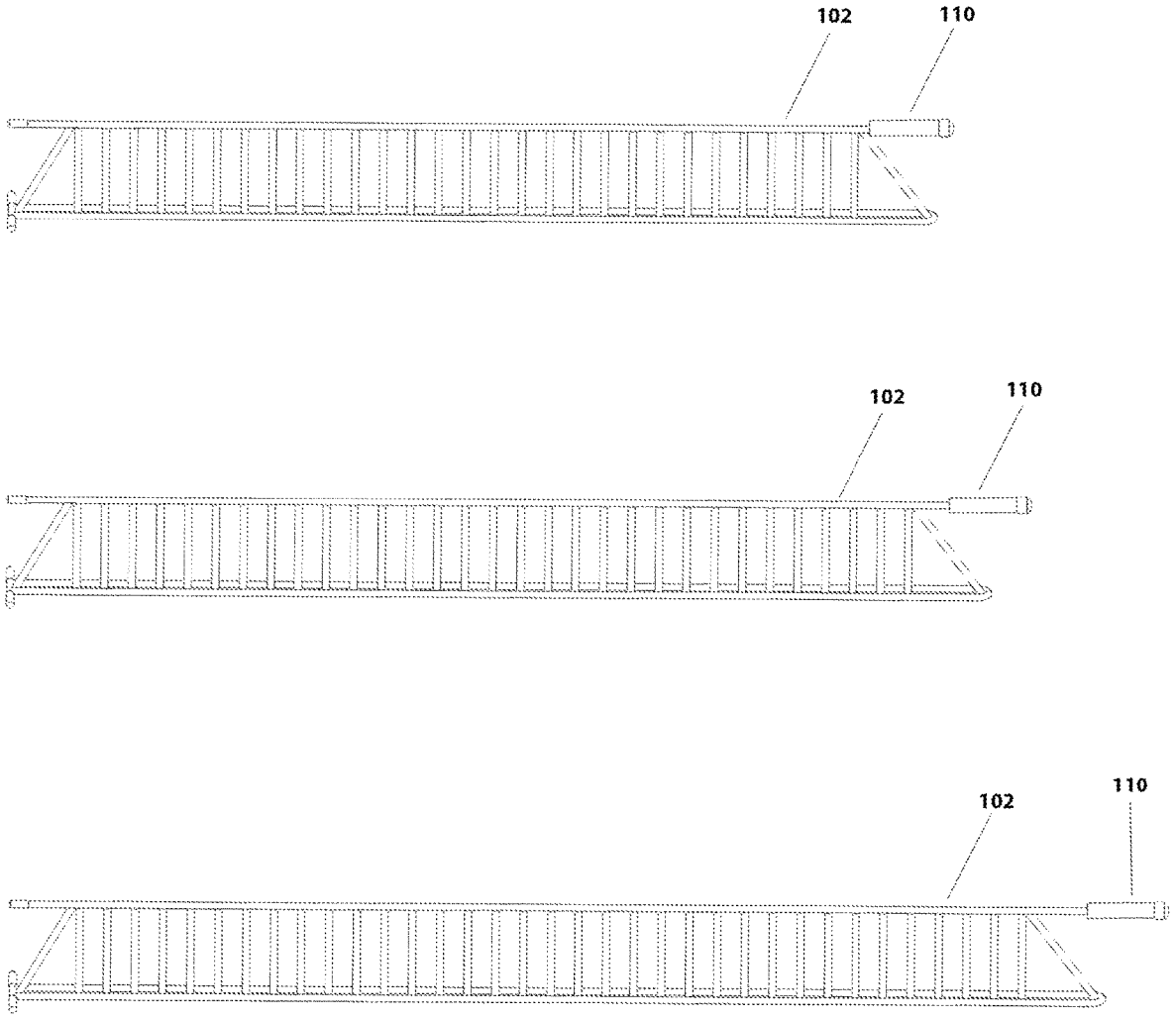
FIG. 4 is a side view of several rail assemblies, adjusted to various lengths.

FIG. 3A and FIG. 3B demonstrate how the threaded cap 110 screws onto the threaded member 108 at the end of the rail assembly. The threaded cap 110 can be adjusted along the threaded member 108 and over the upper member 102 to change the length of the rail assembly and secure it firmly in place within an enclosure using tension. This allows the modular organizer system to be secured within an enclosure, so it does not slide around or become disorganized when the drawer is open or closed. The user will appreciate that in one embodiment the threaded member 108 has a larger diameter than the upper member 102, which allows the threaded cap 110 to pass easily over the upper member without catching (FIG. 3B). This feature also obscures the thread from view when the rail assembly is installed within an enclosure, creating a neat and uniform appearance. In one embodiment the threaded cap may be made out of metal such as aluminum or stainless steel and the outside surface may be knurled to provide a better grip for the user during installation and use. FIG. 4 shows how these features work in concert with different lengths of rail assemblies to allow a user to configure the modular organizer system precisely to any desired length by adjusting the threaded cap 110 along the threaded member 108 and over the upper member 102.

Figure 5A:
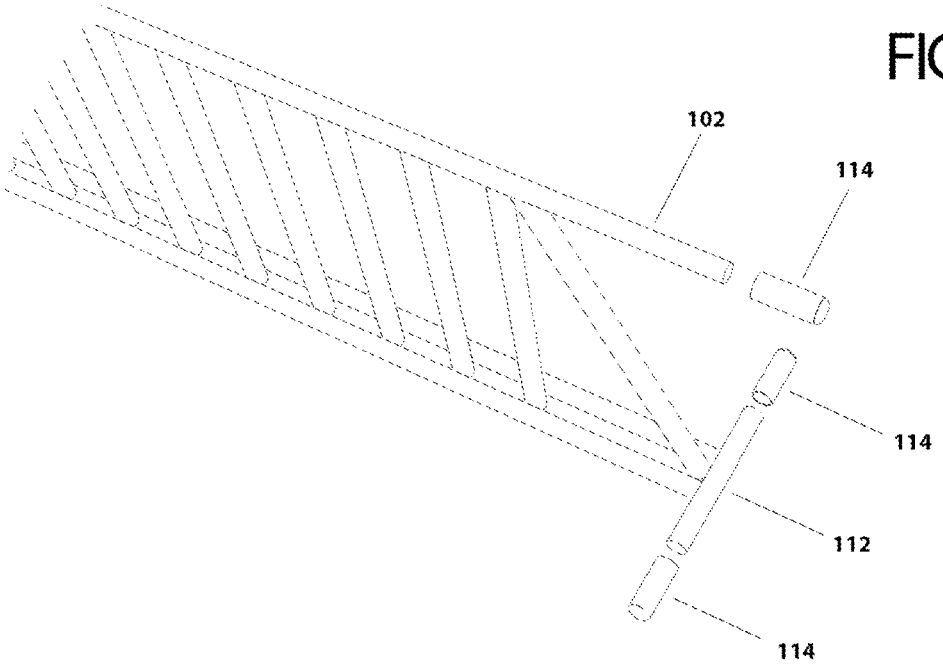
FIG. 5A. is an enlarged view of the front of the rail assembly highlighting the bumpers.
Figure 5B:
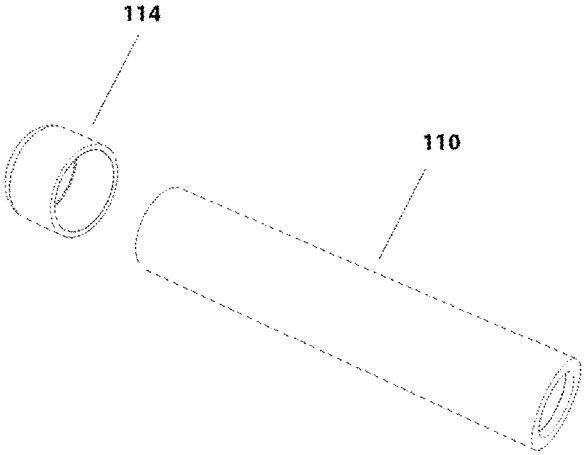
FIG. 5B. is an enlarged view of the back of the threaded cap highlighting the bumpers.

FIG. 5A and FIG. 5B show how the bumpers 114 fit over the ends of the upper member 102, the cross member 112, and the end of the threaded cap 110 to provide a more secure grip inside an enclosure. This is particularly relevant for enclosures made out of smooth materials such as lament, plastic, or metal. In one embodiment the bumpers may be made out of rubber, PVC, or vinyl material.

Figure 6:
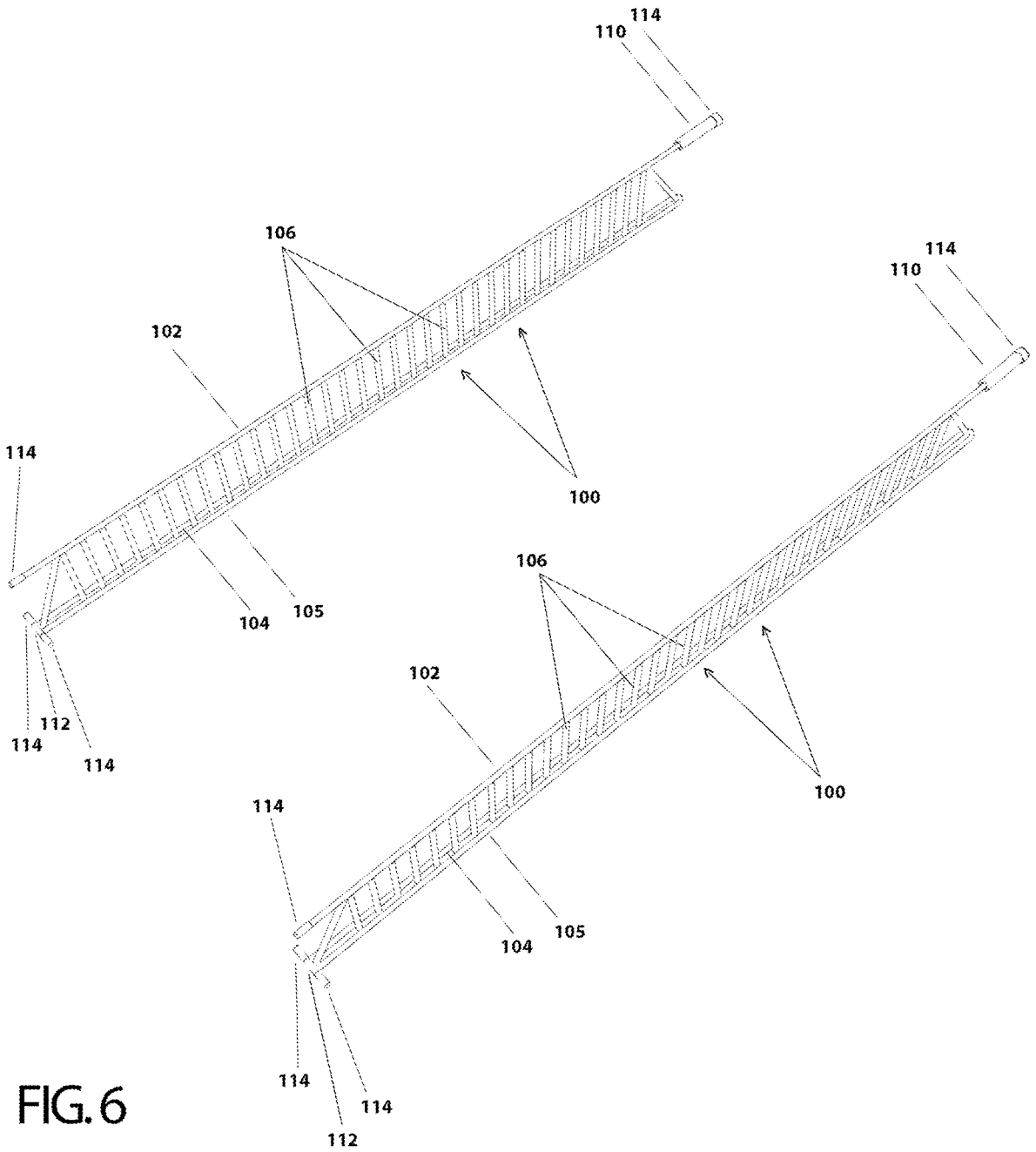
FIG. 6 is a perspective view of two rail assemblies positioned parallel to each other.

FIG. 6. Shows how additional rail assemblies can be positioned, with the side walls 100 parallel to each other, to create the structure for the other basic components of the modular organizer system.

Figure 7A:
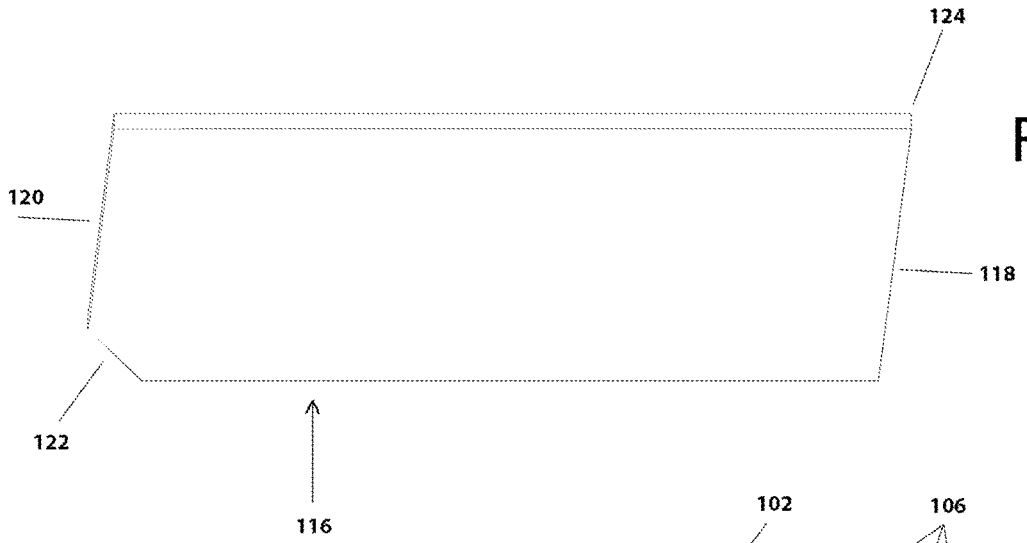
FIG. 7A is a frontal view of the divider.
Figure 7B:
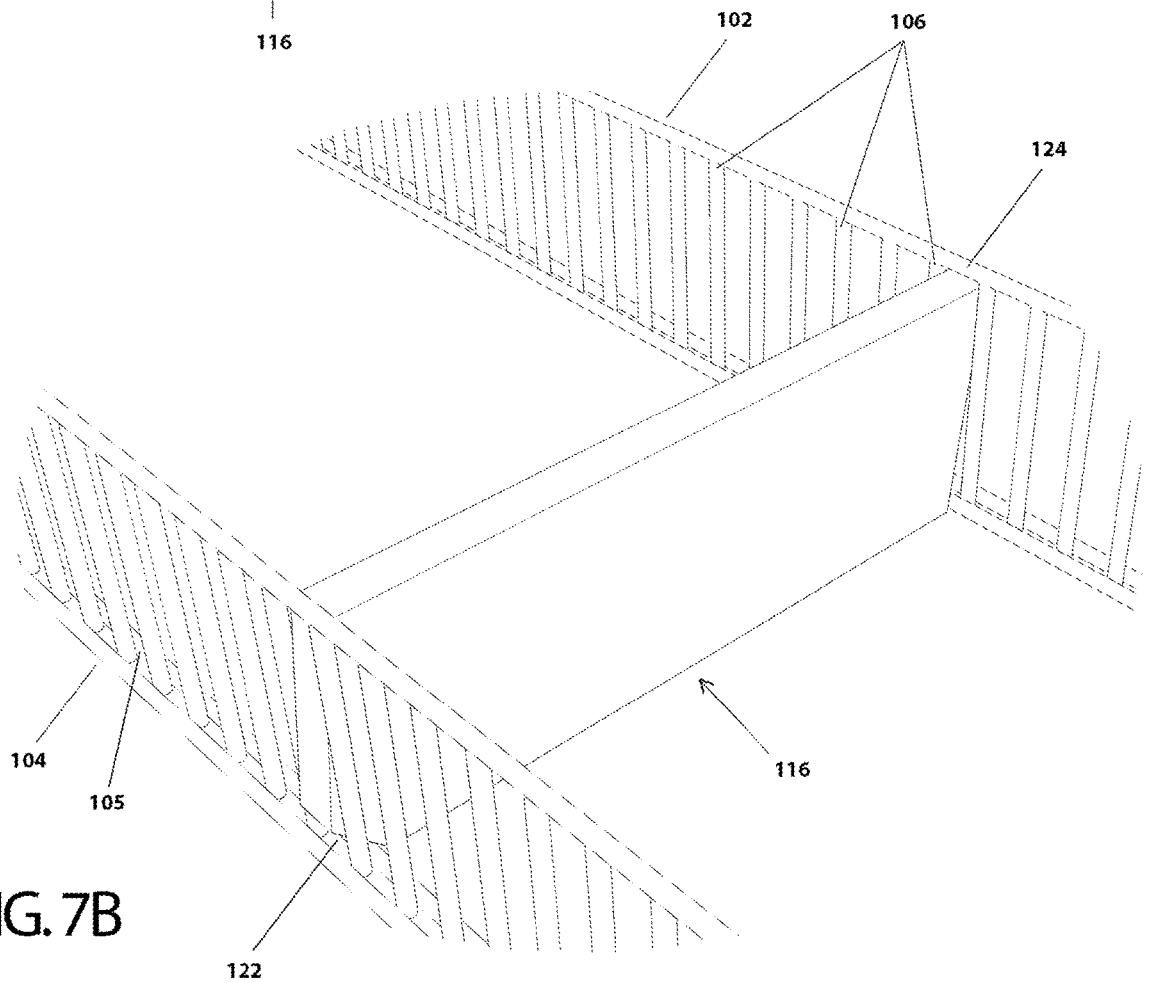
FIG. 7B is a perspective view showing a divider placed between two rail assemblies.
Figure 8:
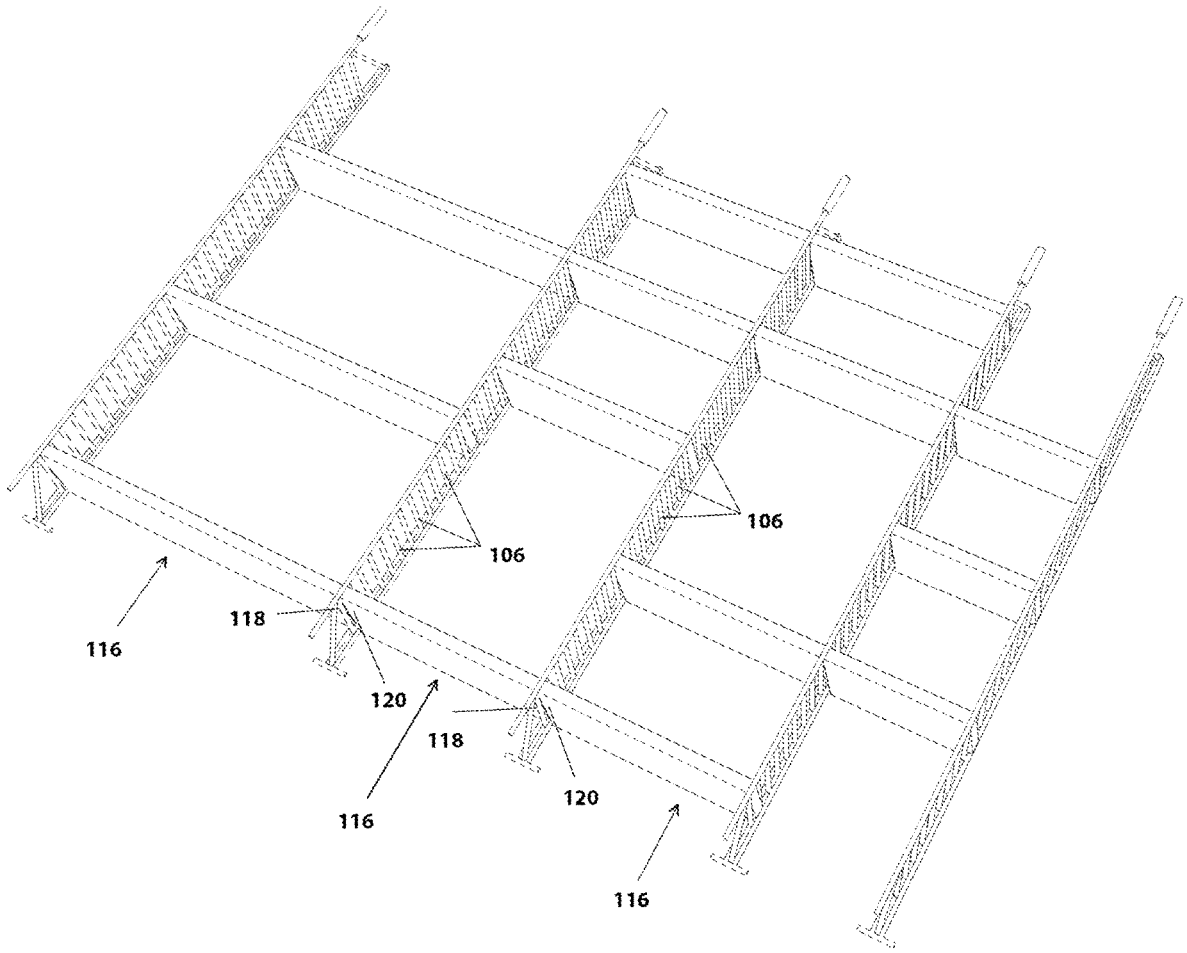
FIG. 8 is a perspective view of multiple dividers placed between multiple rail assemblies, set up in a potential configuration.

FIG. 7A illustrates one embodiment of a divider 116, which is composed of a first angled side 118 and a second angled side 120, that are approximately parallel to each other, with a notch 122 on one end and a tip 124 on the other. The dividers come in multiple lengths so that rail assemblies can be configured to multiple widths. FIG. 7B shows how a divider is placed between rail assemblies, positioned perpendicular to the side walls 100 and secured in place between the support members 106 without the need of any additional hardware. This allows for easy installation and use of the system without requiring any tools. On one side the divider notch 122 rests against the lower member 105 and the divider tip 124 extends underneath the upper member 102. The consistent spacing between the support members 106 creates uniform gaps that match the thickness of the dividers 116 so that they can fit perfectly at virtually any point along the rail assembly between support members 106. FIG. 8 shows one possible configuration of how the dividers can be arranged between multiple rail assemblies to create various sized containers for a plurality of items. It also illustrates how the dividers can be positioned between additional rail assemblies to seamlessly configure the modular organizer system to different widths to fill out enclosures of different dimensions. This includes forming continuous lines with the dividers 116 where the angled divider first side 118 aligns with the angled divider second side 120 within the same gap between support members 106.

In one embodiment the dividers may be made out of bamboo or wood (e.g. walnut, oak, or plywood). The bamboo may be cut manually or with a CNC machine. In one embodiment the support members may be made of gauge 11 wire (⅛" diameter) and spaced ½" on center, creating uniform ⅜" gaps that would be matched by ⅜" thick dividers.

Figure 10:
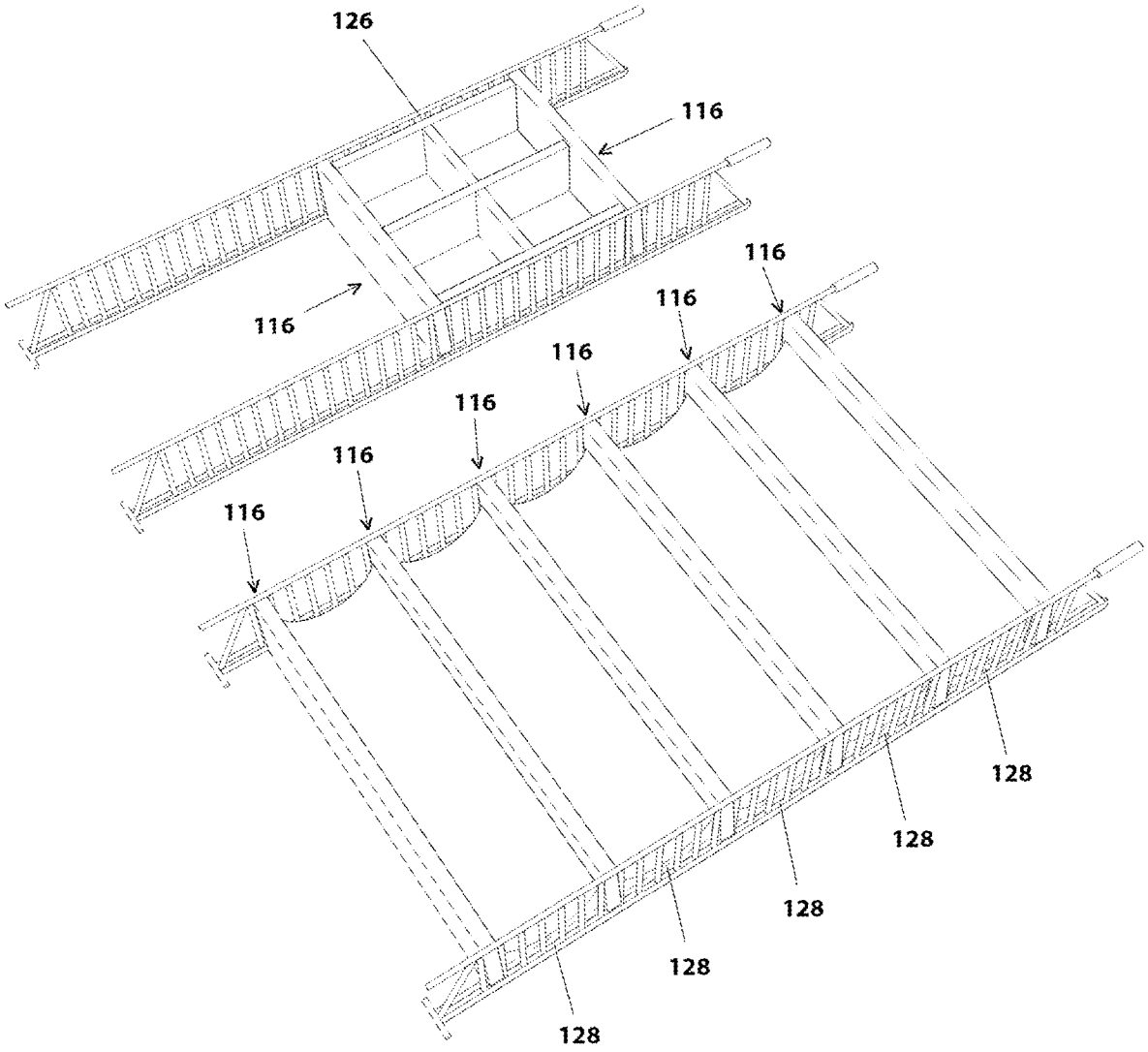
FIG. 10 shows the two accessories from FIG. 9A and FIG. 9B placed in potential configurations between rail assemblies.

In addition to the system components noted above, the disclosed modular organizer system can also include a plurality of accessories tailored to different items. FIGS. 9A and 9B show embodiments of two accessories in the form of a box shape 126 and bowl shape 128 that can be positioned virtually anywhere along the rail assembly and secured in place between dividers 116. The user will appreciate that the box shape 126 creates small compartments that are ideal for the organization and containment of small items and sundries. The bowl shape 128 has a curved base which neatly cradles items stored within and allows the user easy access to retrieve said items. FIG. 10 shows the aforementioned accessories placed within rail assemblies in potential configurations and secured firmly between dividers 116 so that they will not slide out of position or become disorganized.

FIG. 11A to 11B show embodiments of two accessories in the form of a spice rack 130 and knife block 132 that can be secured in place virtually anywhere along the rail assembly with a peg 134 on both sides of the accessory. The peg 134 diameter matches the uniform gap between support members 106 and the thickness of the dividers 116. When installed, the peg 134 would mount flush with the far side of the support members 106 and be secured firmly between them. The user will appreciate that the lower members 104 and 105 on the rail assembly create a gap between the peg 134 and any other accessories that would be placed adjacent so that the user is not limited in configuring the modular organizer system and may set up accessories in virtually any place they desire between rail assemblies with the pegs 134 secured between support members 106. The pegs 134 may be integrated into the accessories or come included as a separate component.

Figure 13:
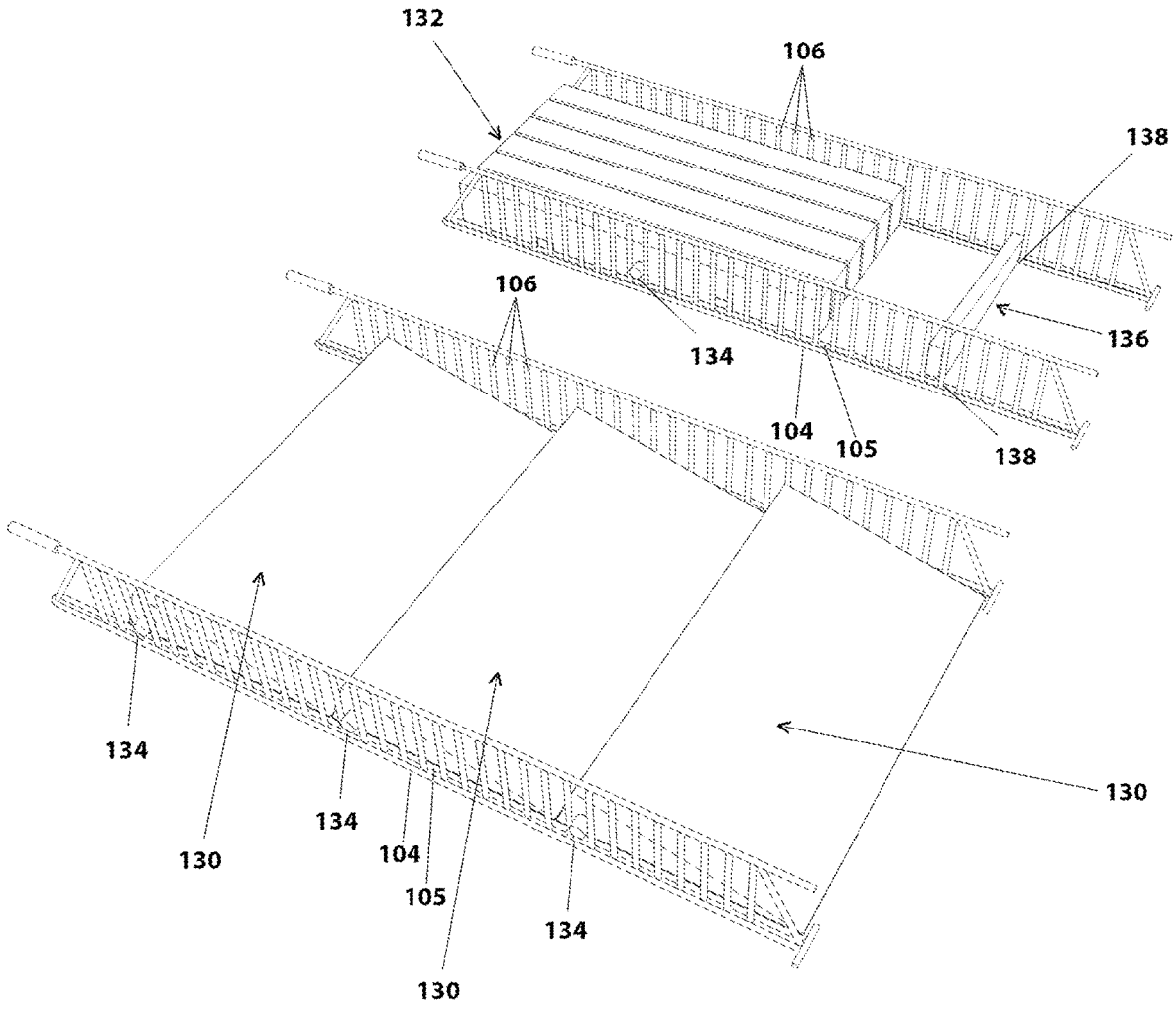
FIG. 13. shows the accessories from FIG. 11A, FIG. 11B, and FIG. 12 placed in potential configurations between rail assemblies.

FIG. 12 shows a utility insert in the form of a knife rest 136 that can be positioned virtually anywhere in the rail assembly in a manner similar to the dividers with the accessory notches 138 resting against the lower members 104 and 105 and the sides constrained between the support members 106. The user will appreciate the sloped top 140 of the knife rest, which accommodates knives of different sizes and different heights to be placed next to each other while maintaining a neat and uniform appearance. FIG. 13 shows the aforementioned accessories from FIG. 11A. through FIG. 12 placed within rail assemblies in a potential configuration and secured firmly between support members 106 so that they will not slide out of position or become disorganized.

Most accessories can be arranged modularly to the fit the needs of the user. For example, the spice rack 130 can be configured with one, two, three or more rows depending on user preference and available space as seen in FIG. 13. Similarly, any number of bowl shape accessories 128 can be strung together between dividers 116 as shown in FIG. 10. This allows the user to position accessories within the modular organizer system in myriad configurations to suit one's individual needs.

In one embodiment the accessories may be made out of the same material as the dividers (e.g. bamboo) to produce a neat and uniform look when paired together. They may be manufactured manually or with a CNC machine. In one embodiment the peg diameter is ⅜" to match the divider thickness and uniform gaps between the support members.

Though not disclosed or described herein, any number of other accessories can be provided for use with and mounted onto the rail assemblies. Further, the modular organizer system can be configured using only one or more accessories with no dividers installed.

Figure 14:
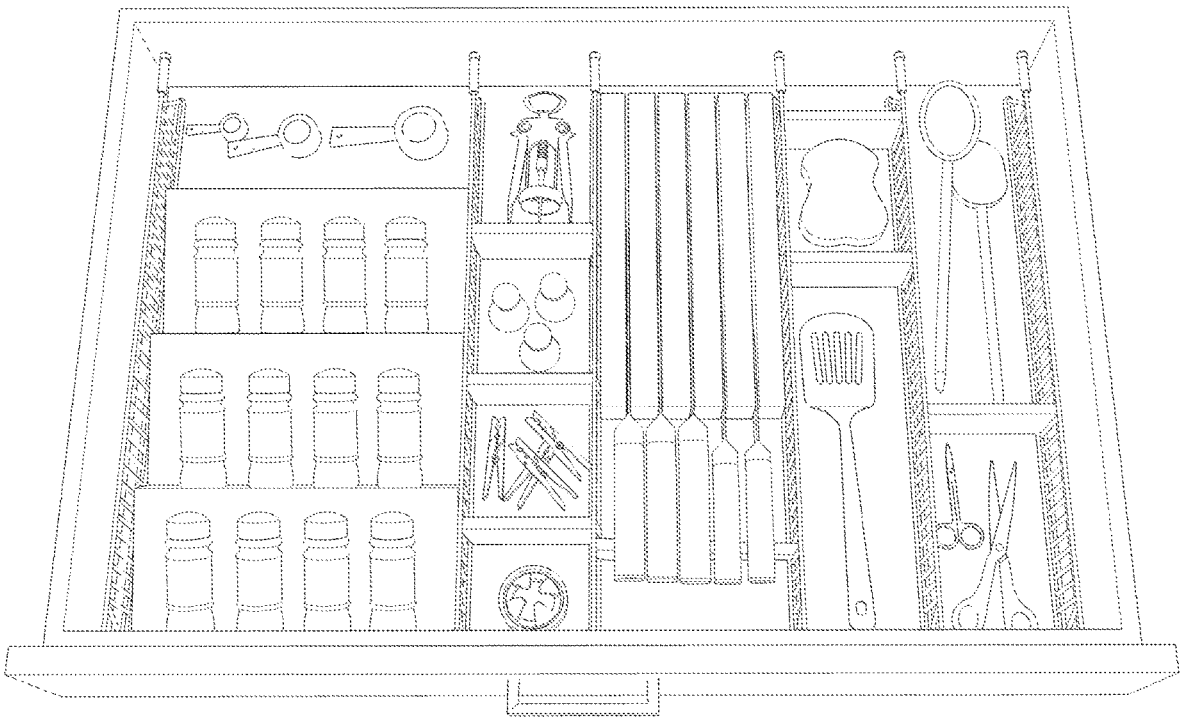
FIG. 14 shows an example of the modular organizer system operating within a drawer and containing various items, assembled in a potential configuration in accordance with the teachings of the present invention.
Figure 15:
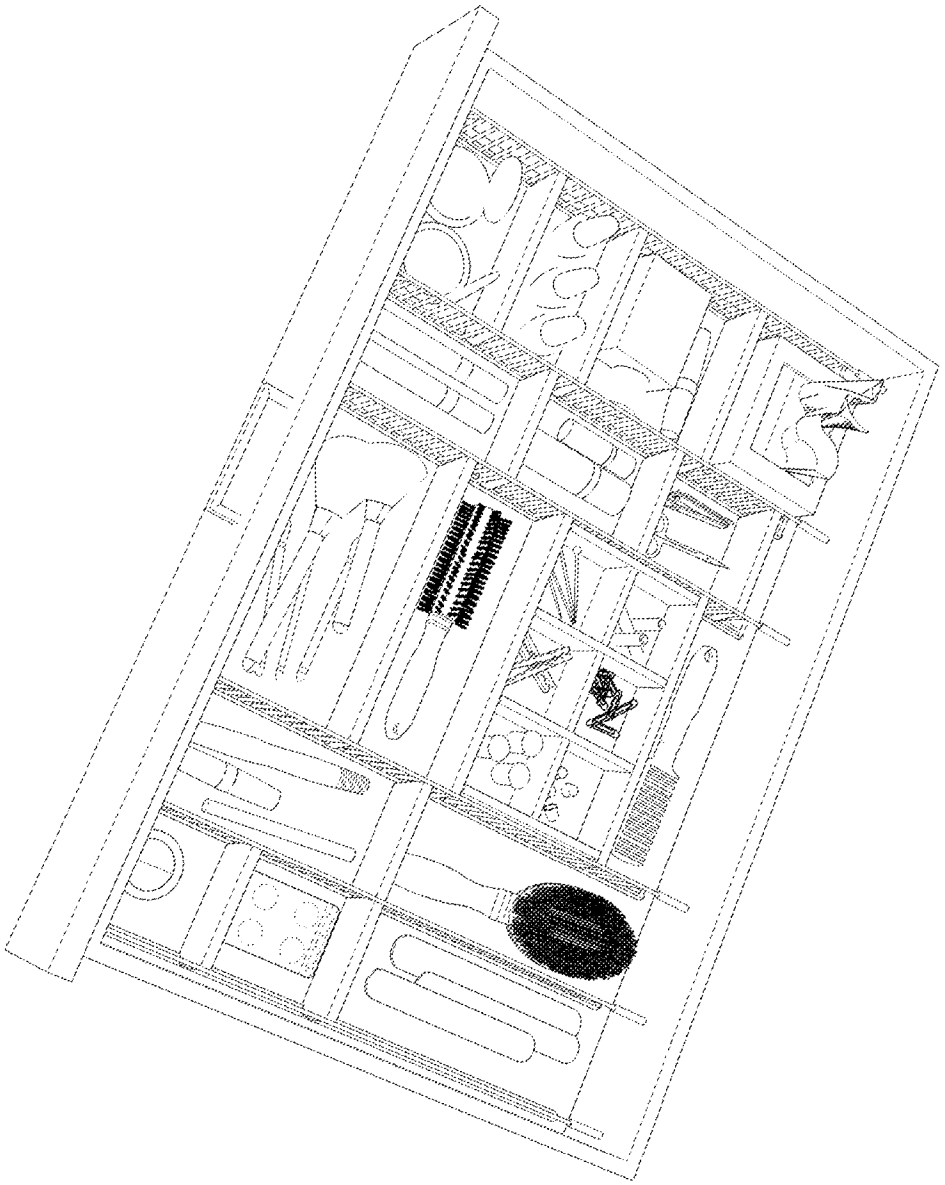
FIG. 15 shows an example of the modular organizer system operating within a drawer and containing various items, assembled in a potential configuration in accordance with the teachings of the present invention.

FIGS. 14 to 15 give contextual examples of how some of the basic components of the modular organizer system described above may be set up in potential configurations inside enclosures and used to organize various items.

DETAILED DESCRIPTION—OPERATION

The modular organizer system is easy to install and does not require any tools or additional hardware to set up. First one selects rail assemblies that are the approximate length of the enclosure and optionally attaches the bumpers 114 to the end of the upper member 102, ends of the cross member 112, and back of the threaded cap 110 (FIG. 5A and FIG. 5B).

Next, one places the rail assemblies inside the enclosure (e.g. drawer) with the cross members 112 against the front edge of the enclosure and the threaded caps 124 towards the back (FIG. 1). Then one positions the rail assemblies an appropriate distance away from each other using the dividers 116 as spacers (FIG. 6 and FIG. 7B). In this way the user can seamlessly combine rail assemblies to fill out the width of the enclosure.

Next, one adjusts the threaded caps 110 along the threaded members 108, tightening them against the back of the enclosure to secure the rail assembly firmly in place with tension (FIG. 3A and FIG. 3B). Then one places dividers 116 at desired locations between the rail assemblies, perpendicular to the side walls 100, to form custom containers (FIG. 8). This is achieved by first placing the divider tip 124 underneath the upper member 102 and then lowering the divider notch 122 to rest against the lower member 105 (FIG. 7B). In this way both sides of the divider, 118 and 120, are constrained firmly between the support members 106.

Finally, one positions any desired accessories between the rail assemblies and then secures them in place using dividers 116, pegs 134, or constrained directly between the support members 106 (FIG. 10 and FIG. 13). If using dividers, the dividers are installed in the manner described above. If using pegs, the peg 134 is placed between and constrained within the support members 106.

Now that the modular organizer system is installed, one can place various items within the custom containers and on the desired accessories (FIG. 14 and FIG. 15). The system can be adjusted into different configurations before or after installation within the same drawer or re-used in drawers with different dimensions. It will not shift around or become disorganized, does not substantially alter the appearance of the drawer, and maintains a neat and uniform appearance in every configuration. It does not obscure items placed within, does not take up valuable space in shallow enclosures, and can be configured in myriad combinations to the suit the individual needs of the user.

DETAILED DESCRIPTION—ALTERNATIVE EMBODIMENTS

Figure 16E:
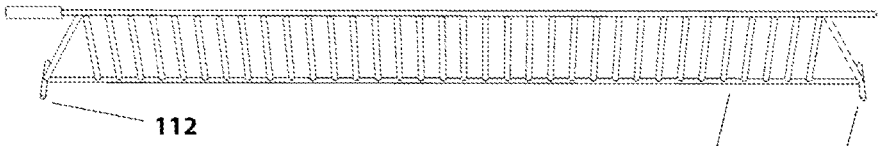
FIG. 16E shows an alternative embodiment of the rail assembly.
Figure 16D:
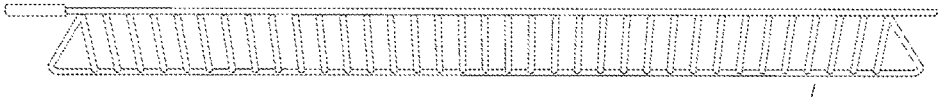
FIG. 16D shows an alternative embodiment of the rail assembly.
Figure 16C:
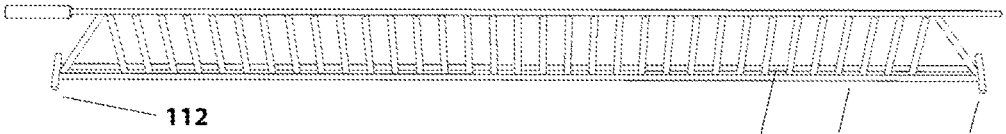
FIG. 16C shows an alternative embodiment of the rail assembly.
Figure 16B:
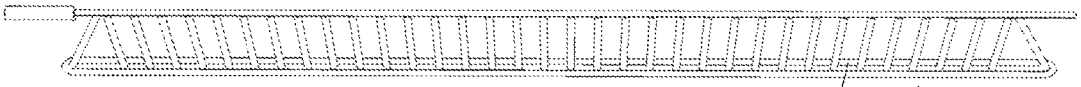
FIG. 16B shows an alternative embodiment of the rail assembly.
Figure 16A:
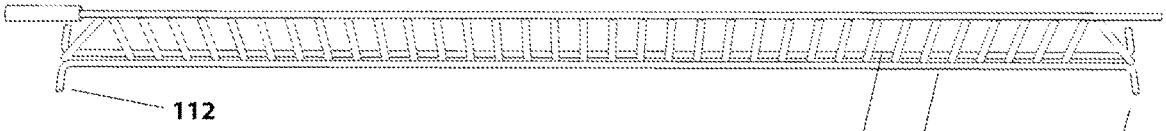
FIG. 16A shows an alternative embodiment of the rail assembly.

Additional embodiments of the rail assembly are shown in FIG. 16A through FIG. 16E. In FIG. 16A and FIG. 16C there is a cross member 112 at both the front and rear of the lower members 104 and 105. In FIG. 16A the cross members are formed by bending the lower members 104 and 105 outward. In FIG. 16B there is no cross member 112 present on the rail assembly. In FIG. 16D there is only one lower member 104 with no cross member 112. In FIG. 16E there is only one lower member 104 with a cross member 112 at both the front and back. A rail assembly may have any number of cross members and lower members. Alternatively, it may have no cross members at all.

Figure 17:
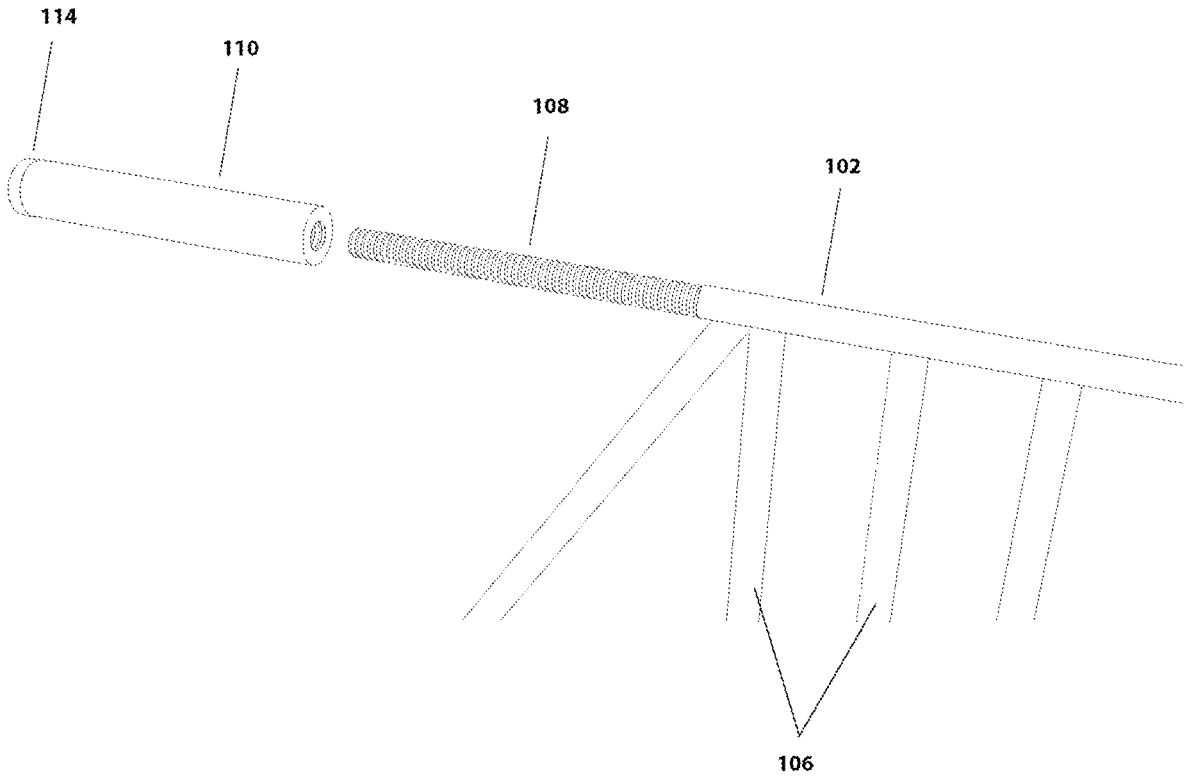
FIG. 17 shows an alternative embodiment of the threaded member, threaded cap, and bumpers.

FIG. 17 shows additional embodiments of the threaded member 108, threaded cap 110, and bumpers 114. In this embodiment the threaded member 108 extends along the upper member 102 until the first support member 106. The threaded member 108 is the same diameter as the upper member 102 and the rubber bumper 114 is integrated into the threaded cap 110 for a neat and uniform appearance. The threaded member and threaded cap may come in multiple sizes and shapes. The bumpers may be integrated seamlessly into the upper member 102, cross member 112, and threaded cap 110 or included as separate attachments.

Figures 18A, 18B:
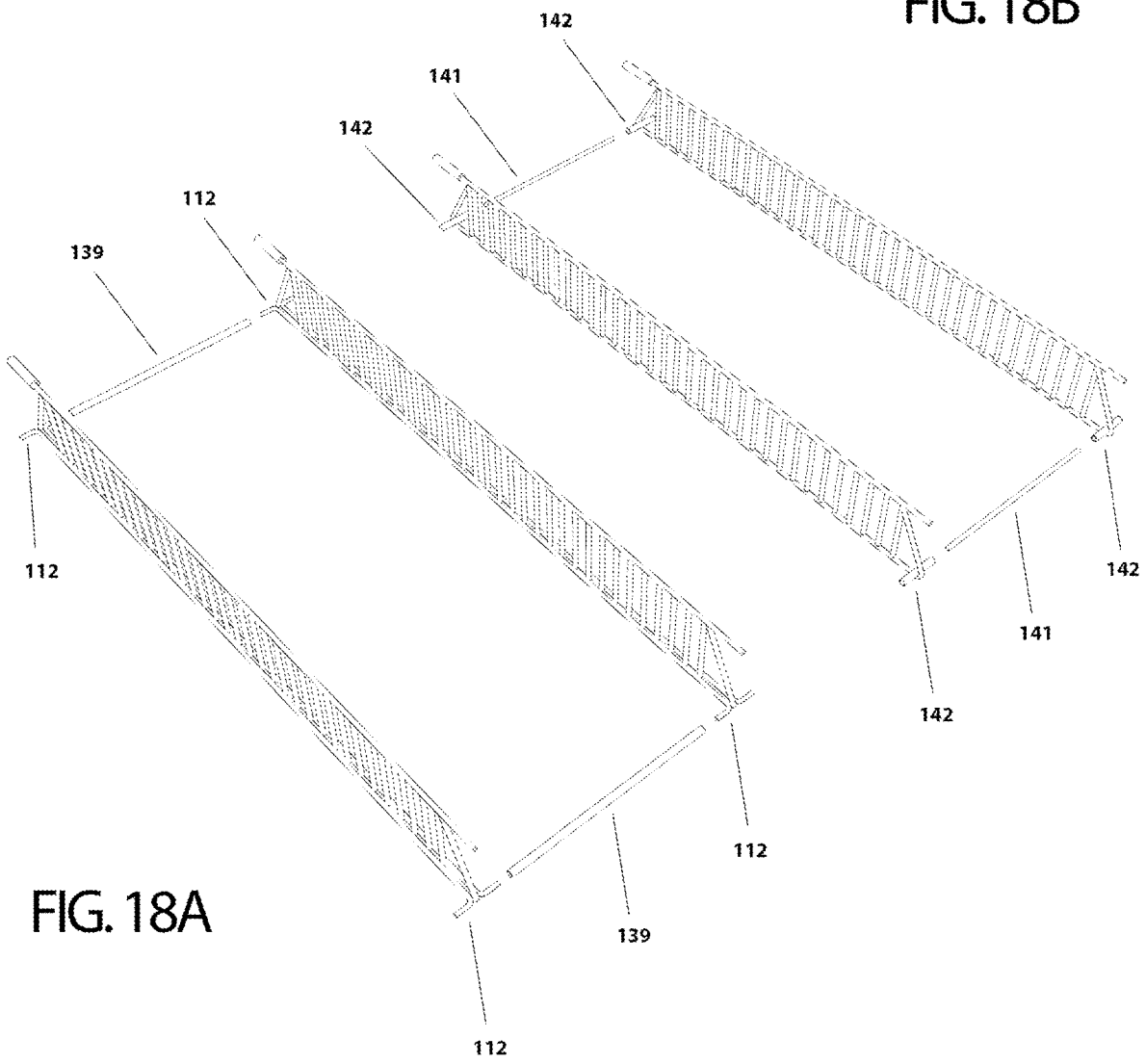
FIG. 18A shows an alternative embodiment of the rail assembly.
FIG. 18B shows an alternative embodiment of the rail assembly.

FIG. 18A and FIG. 18B illustrate how rail assemblies can be potentially connected together at the cross members 112 using tube members 139 or rod members 141. In FIG. 18A the female tube members 139 connect over the male cross members 112 at both ends of the rail assembly. FIG. 18B shows male rod members 141 that connect to female cross member tubes 142 at both ends of the rail assembly. The tube members 139 and rod members 141 may come in multiple lengths to configure the rail assemblies to various widths. The cross members 112, cross member tubes 142, tube members 139 and rod members 141 may also be threaded for a firmer connection.

Additional embodiments of the rail assembly are shown in FIG. 19A to 21B. Each one illustrates a different method to expand the length of the rail assembly using rail extenders 144. A rail extender 144 looks and functions like a section of the sidewall 100 with a similar upper member 102, lower member 104, and plurality of support members 106.

Figure 19A:
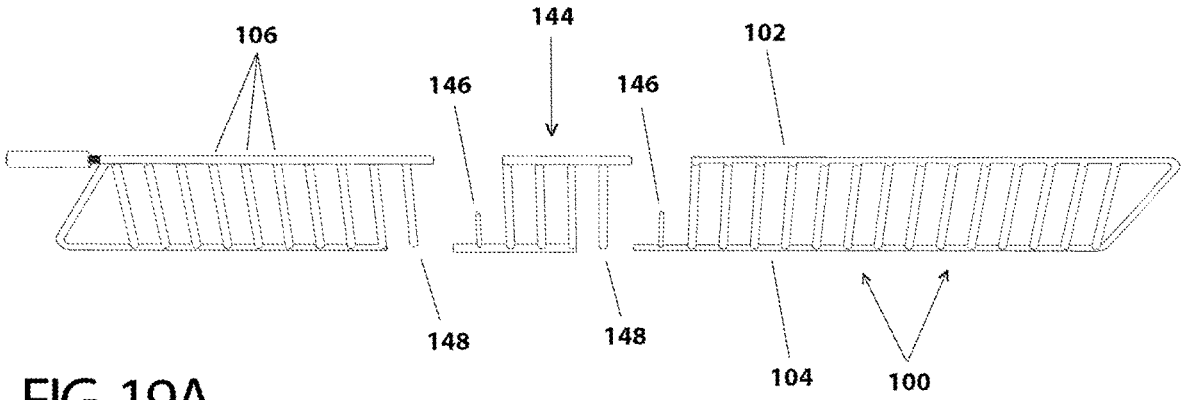
FIG. 19A shows one embodiment of the rail extender and how a rail extender connects to the rail assembly.
Figure 19B:
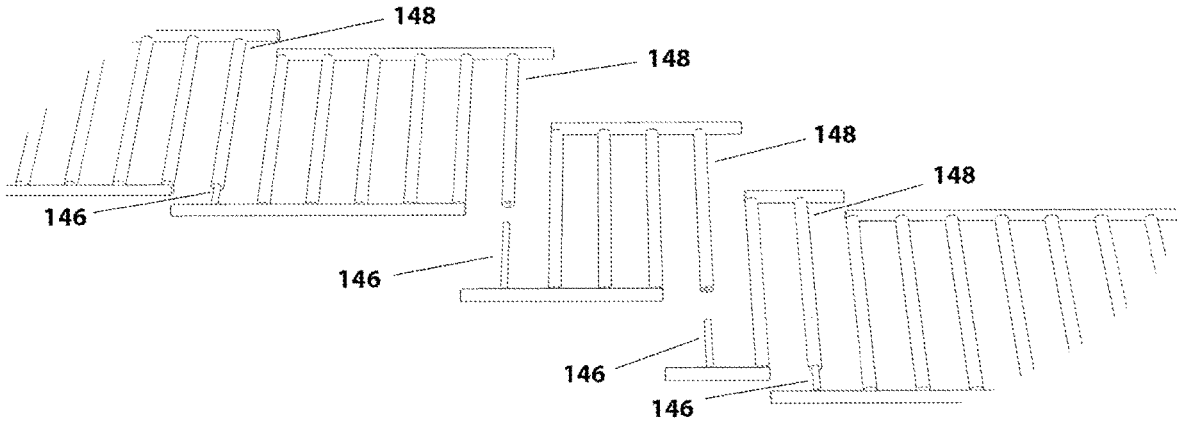
FIG. 19B shows one embodiment of the rail extender and how a rail extender connects to the rail assembly.

FIG. 19A and FIG. 19B show a rail extender 144 with male support protrusions 146 at one end and female support tubes 148 at the other end. The support protrusions 146 have an outer diameter that fits perfectly inside the inner diameter of the support tubes 148. The protrusions and tubes connect together to seamlessly extend the length of the rail assembly. The rail assembly can be configured with as many rail extenders 144 as desired or without any at all. Additionally, the rail extender 144 and rail assembly may have any number of support protrusions 146 and support tubes 148.

Figure 20A:
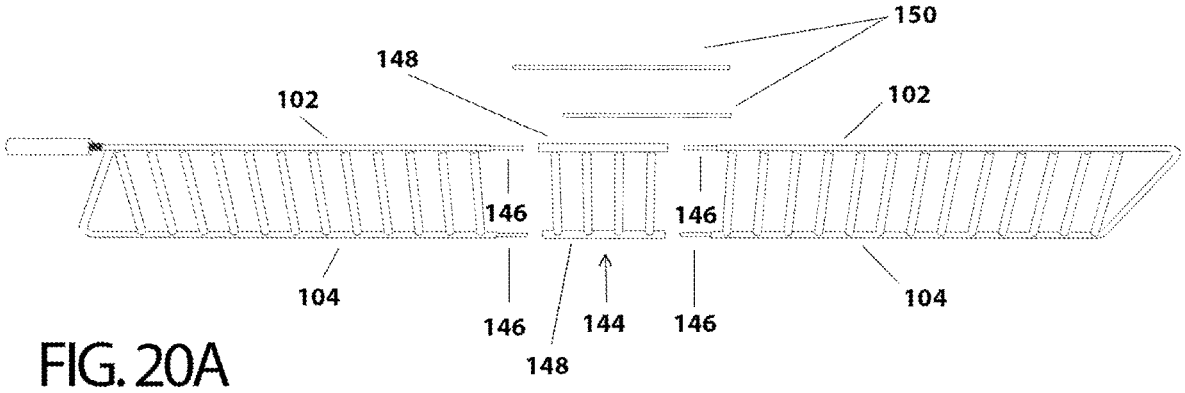
FIG. 20A shows one embodiment of the rail extender and how the rail extender connects to the rail assembly.
Figure 20B:
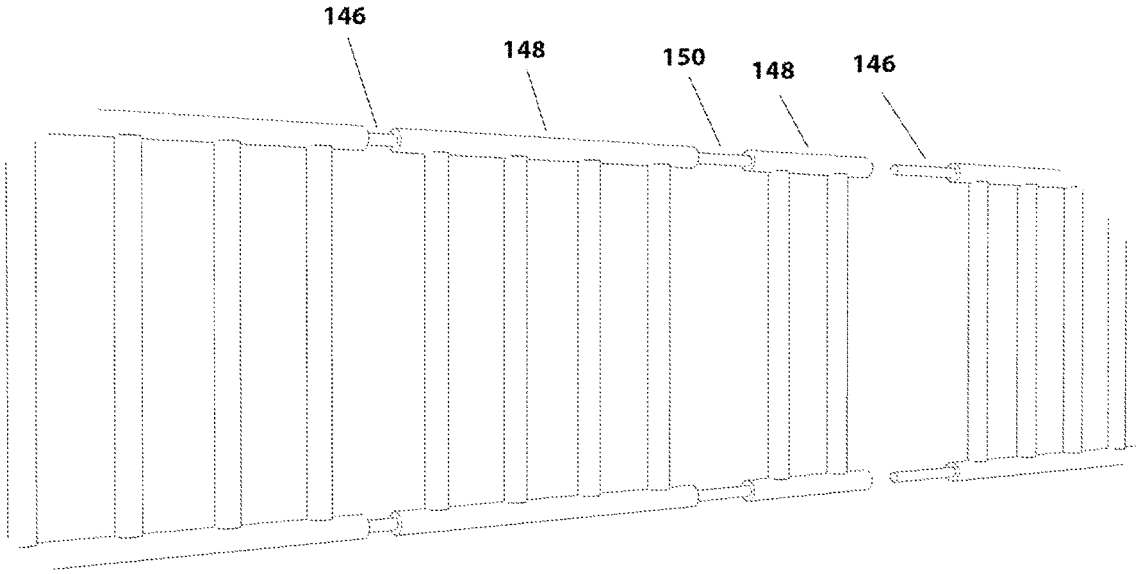
FIG. 20B shows one embodiment of the rail extender and how the rail extender connects to the rail assembly.

In FIGS. 20A and 20B the support protrusions 146 extend off the ends of the upper member 102 and lower member 104 of the rail assembly. The support tubes 148 replace the upper member 102 and lower member 104 on the rail extender 144. Additional separate support rods 150 are used to connect multiple rail extenders 144 together before being coupled to the rail assembly. The support rods 150 come in various sizes to allow the user to connect virtually any number of rail extenders 144 together.

Figure 21A:
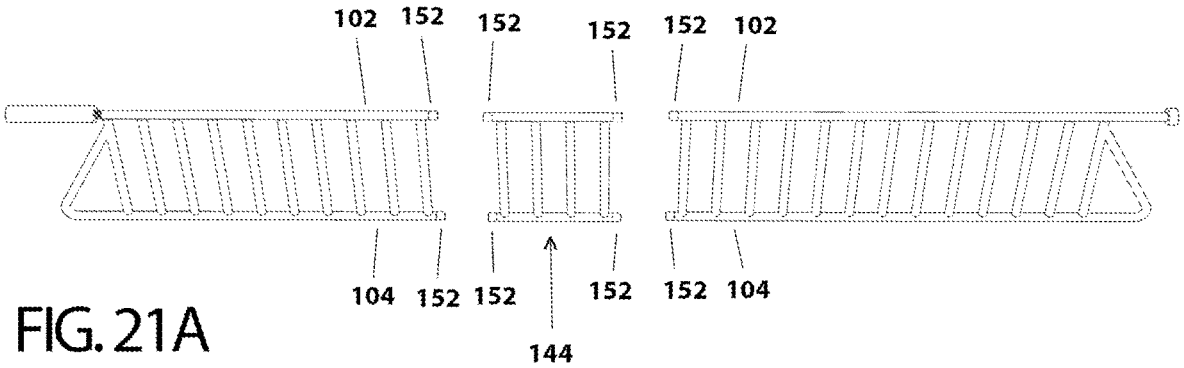
FIG. 21A shows one embodiment of the rail extender and how the rail extender connects to the rail assembly.
Figure 21B:
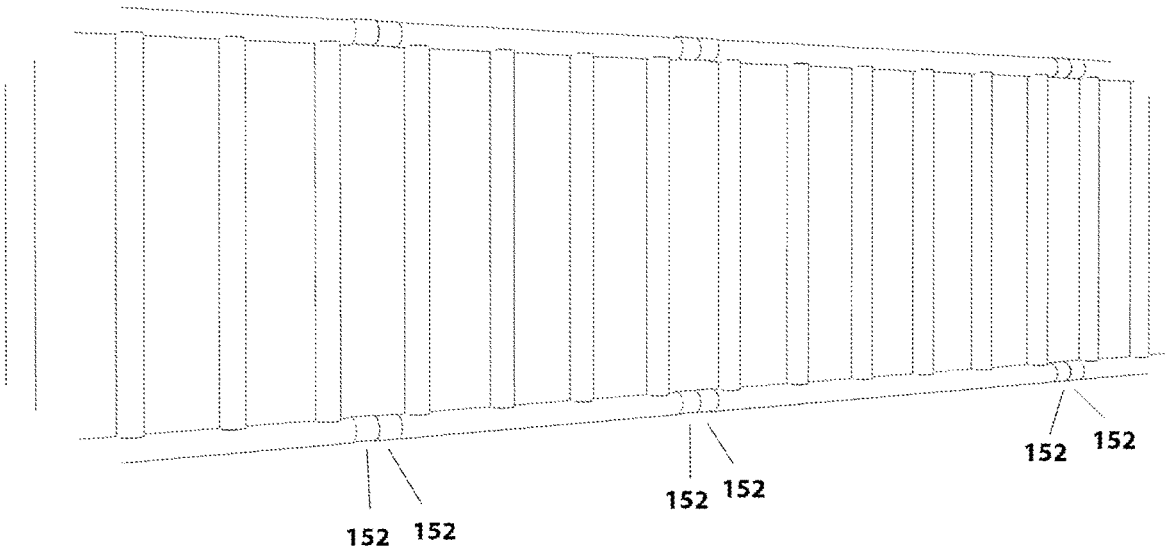
FIG. 21B shows one embodiment of the rail extender and how the rail extender connects to the rail assembly.

In FIGS. 21A and 21B all the support rods and support tubes are replaced by magnets 152 which are positioned at the ends of the upper member 102 and lower member 104 on both the rail assembly and rail extender 144. The magnets are axially magnetized to bond together when connecting the rail extenders 144 to the rail assembly and/or to each other. The magnets may come in various sizes and shapes. In one embodiment the magnets are neodymium rare earth magnets that are attached with a two-part epoxy or other adhesive.

Figure 22A:
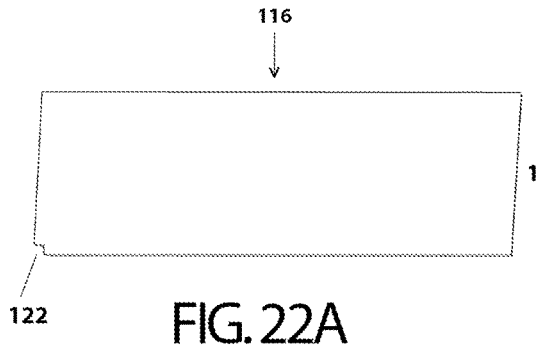
FIG. 22A shows an alternative embodiment of the divider.
Figure 22B:
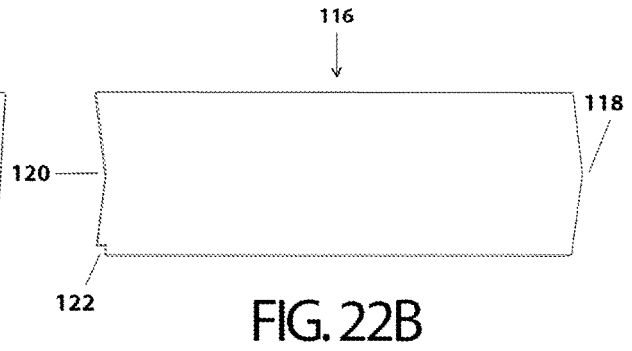
FIG. 22B shows an alternative embodiment of the divider.
Figure 22C:
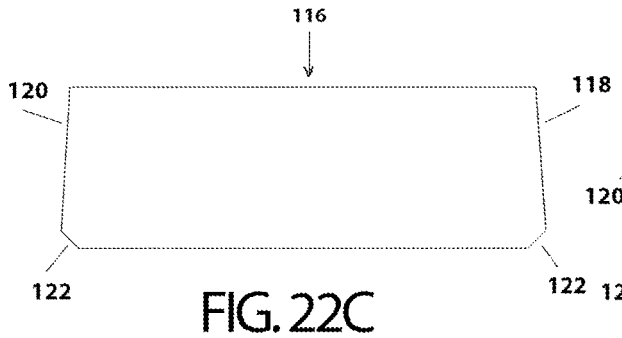
FIG. 22C shows an alternative embodiment of the divider.
Figure 22D:
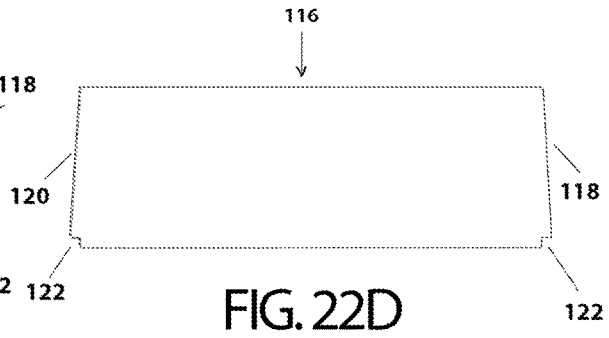
FIG. 22D shows an alternative embodiment of the divider.
Figure 22E:
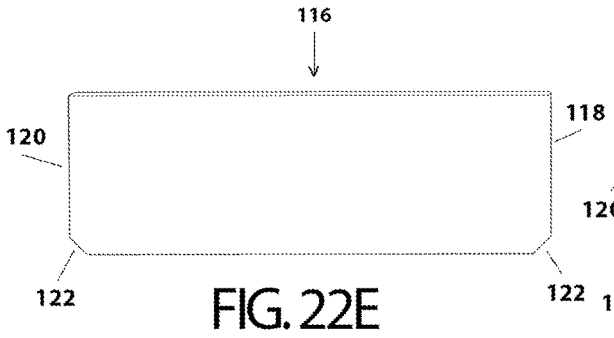
FIG. 22E shows an alternative embodiment of the divider.
Figure 22F:
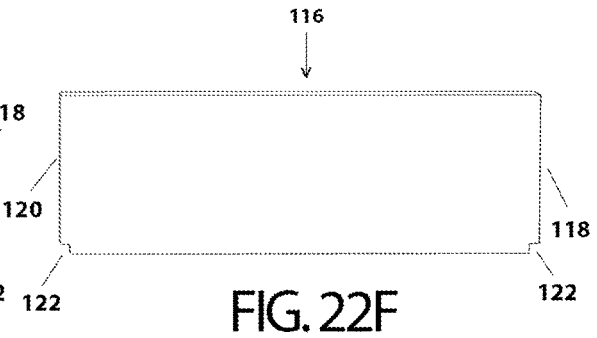
FIG. 22F shows an alternative embodiment of the divider.

Additional embodiments of the dividers 116 are shown in FIG. 22A to 22F. In 22A the divider notch 122 is formed with a right angle to create an area that would sit perfectly on top of the lower members 104 and 105 of the rail assembly. In 22B the sides of the divider, 118 and 120, are angled similar to an arrow to seamlessly join together when connected within the same gap between support member 106. FIG. 22C and FIG. 22D show alternative angles for the sides of the divider, 118 and 120, which would require one divider to be placed upside down before being joined together to form a continuous line. In FIG. 22E and FIG. 22F the sides of the dividers, 118 and 120, are straight so they fill the entire gap between the support members 106. Dividers may come in multiple sizes, shapes, and styles so long as they can be placed between the side walls 100 of the rail assembly to form containers.

Figure 23A:
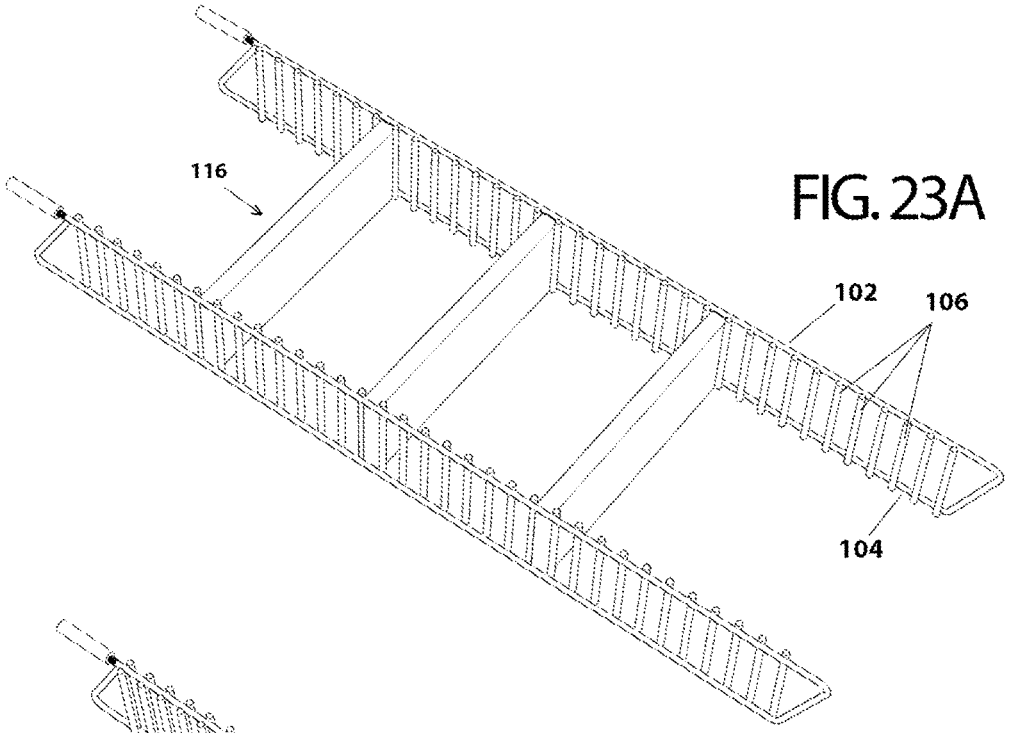
FIG. 23A shows an alternative embodiment of the rail assembly.
Figure 23B:
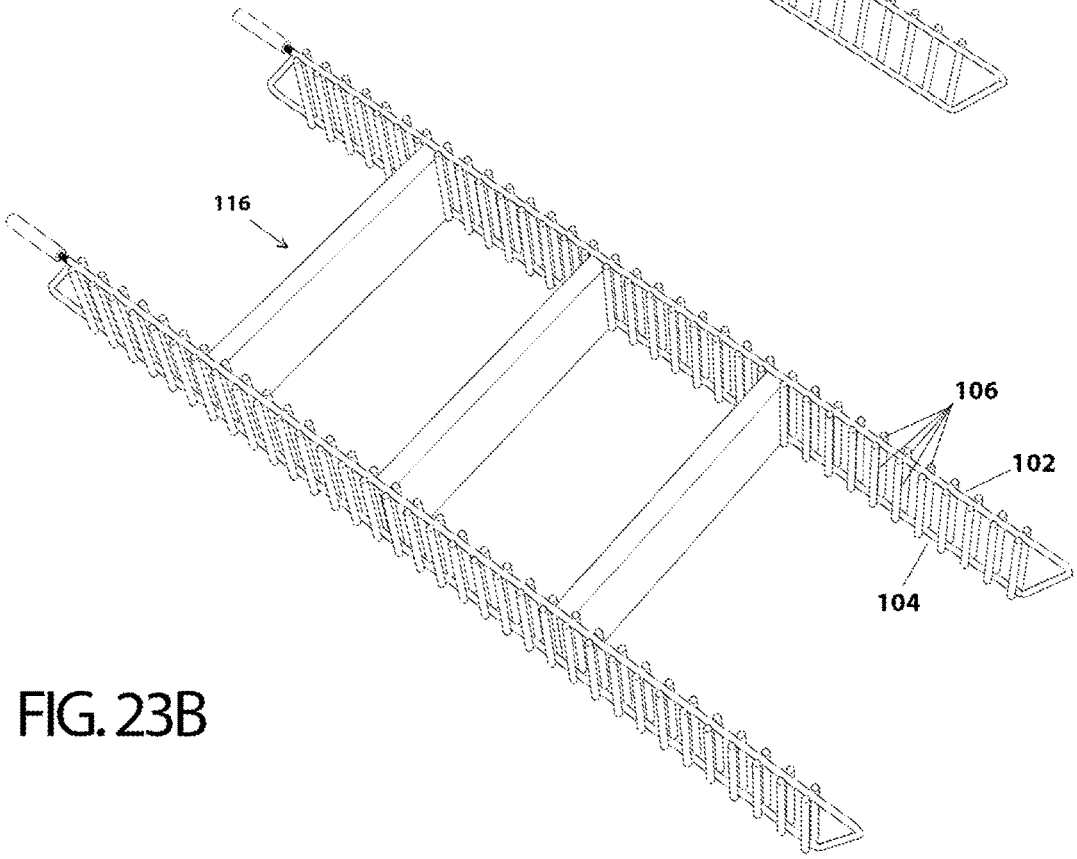
FIG. 23B shows an alternative embodiment of the rail assembly.
Figure 24:
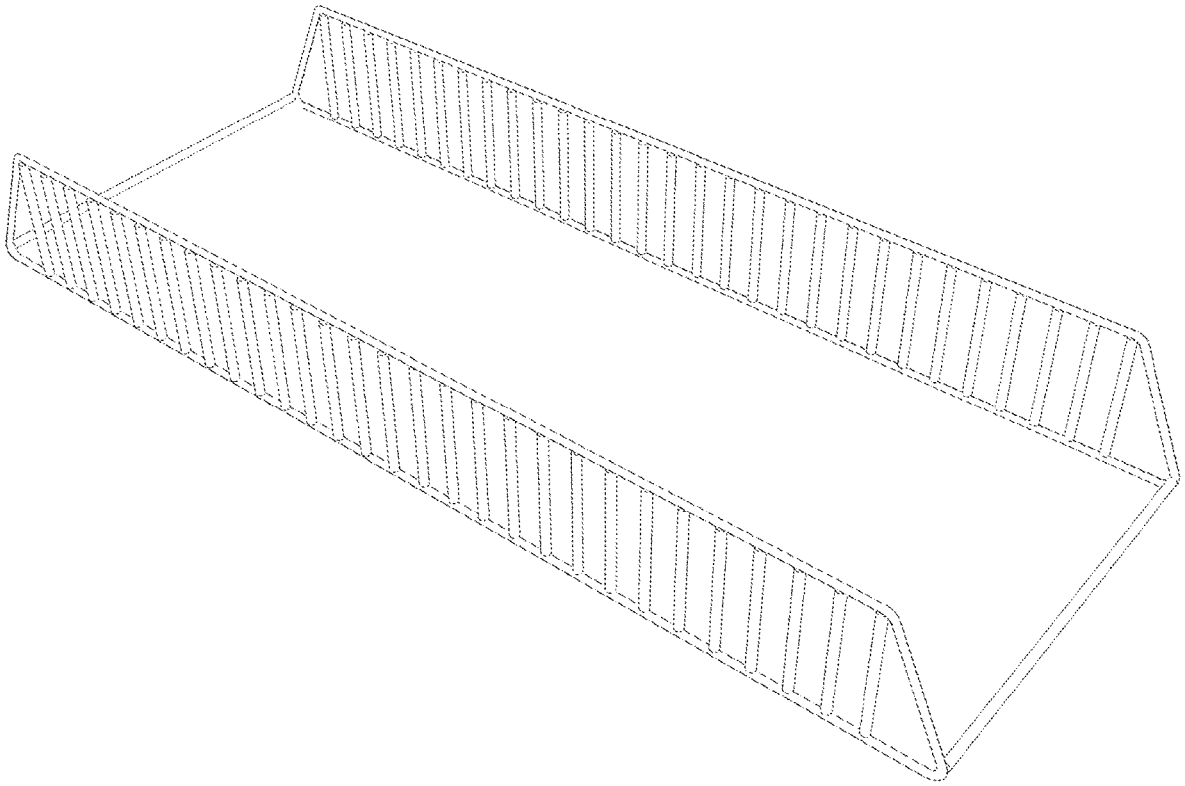
FIG. 24 shows an alternative embodiment of the rail assembly.

Additional embodiments of the rail assembly are shown in FIG. 23A and FIG. 23B. In FIG. 23A the support members 106 are positioned on the inside of the upper member 102 and lower member 104. In FIG. 23B the support members 106 are positioned on both sides of the upper member 102 and lower members 104. In these embodiments the dividers 116 would not require notches 122 or tips 124 and would be installed by sliding directly down between the support members 106. In FIG. 24 the rail assembly is shown without the threaded member and threaded cap, which would be suitable for a tabletop organizer such as one placed on an office desk, kitchen counter, etc.

CONCLUSION, RAMIFICATIONS, AND SCOPE

Thus the reader will see that at least one embodiment of the modular organizer system provides a more adjustable and reconfigurable device that can be used to organize various items. In addition, the device can be set up to any precise length and can be seamlessly combined to virtually any width to accommodate various sized enclosures. It can create custom containers of different sizes within an enclosure, including forming continuous partition lines. It retains a neat and uniform appearance when configured in any combination. It does not significantly obscure or alter the appearance of the drawer when installed and does not take up space in shallow enclosures. It is simple to assemble, requires no tools to set up, and does not use any external clips or hardware. It can be adjusted into different configurations before or after installation within the same drawer or re-used in drawers with different dimensions. It can be secured in place within an enclosure so it will not slide around or become disorganized when the drawer is opened or closed. It does not obscure items placed within the device, making them easy to find. To add further versatility, the device can accommodate myriad accessories that are tailored to different items and work in concert with the dividers to organize a plurality of items to suit the individual needs of the user.

While my above description contains many specificities, these should not be construed as limitations on the scope, but rather as exemplification of one or more embodiments thereof. Many variations are possible.

For example, the rail assemblies can be constructed out of square bars instead of round wire. They can have different shapes, sizes, and may be positioned both front to back and side to side within an enclosure. The side walls can be any height to contain larger items or fill deeper drawers. Rail assemblies can be made from many suitable materials including carbon fiber, plastic, wood, sheet metal, etc. They can be virtually any color and finish, which can be applied with various techniques such as painting, powder coating, anodization, nickel or chrome plating, etc.

The rail extenders can attach to the rail assembly in multiple ways including pins, screws, joints, and other coupling mechanisms. The threaded cap can be made from many suitable materials including nylon, plastic, metal (e.g. aluminum, steel, stainless steel, copper, brass, etc.), wood, etc. The threaded cap may be knurled or have notches/bumps for better grip during installation and use.

The dividers can come in a multitude of shapes and sizes. They can be made of from many suitable materials including metal, stone (e.g. marble, slate, basalt, etc.), plastic, acrylic, ceramic, porcelain, Lucite, vinyl, etc. They can have virtually any aesthetic decoration or print applied to their surface. They can be secured to the rail assembly in many ways including magnets, clips, hooks, ball catch hardware, and other coupling mechanisms.

Any number of accessories can be provided for use with and mounted onto the rail assemblies. These include accessories tailored to specific items such as knives, spices, silverware, dishes, pots, pans, jewelry, makeup, art supplies, disposable coffee and espresso pods, various small sundries, and more. They can be secured to the rail assemblies in various ways including magnets, clips, hooks, ball catch hardware, and other coupling mechanisms.

The system can be used in an enclosure, on a tabletop or desk, or even positioned vertically on a flat surface to act as a vertical storage device.

Accordingly, the scope should be determined not by the embodiments illustrated, but by the appended claims and their legal equivalents. As used in this application, the term "a" or "an" means "at least one" or "one or more."

As used in this application, the term "about" or "approximately" refers to a range of values within plus or minus 10% of the specified number.

As used in this application, the term "substantially" means that the actual value is within about 10% of the actual desired value, particularly within about 5% of the actual desired value and especially within about 1% of the actual desired value of any variable, element or limit set forth herein.

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

Any element in a claim that does not explicitly state "means for" performing a specified function, or "step for" performing a specified function, is not to be interpreted as a "means" or "step" clause as specified in 35 U.S.C. § 112, ¶ 6. In particular, any use of "step of" in the claims is not intended to invoke the provision of 35 U.S.C. § 112, ¶ 6.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A modular organizer system, configured to sort and store items; the modular organizer system comprising:

a first rail assembly further comprising:

a first sidewall further comprising a first sidewall upper member joined to a first sidewall lower member with a first plurality of upright support members;

a second rail assembly further comprising:

a second sidewall, proximate the first sidewall and further comprising a second sidewall upper member joined to a second sidewall lower member with a second plurality of upright support members;

wherein a segregated storage space exists between the first sidewall and the second sidewall;

a first sidewall upper member male threaded member, arranged on a first sidewall upper member first end of the first sidewall upper member; and a first sidewall upper member female threaded cap, threaded onto the first sidewall upper member male threaded member;

wherein adjusting the first sidewall upper member female threaded cap adjusts a first sidewall upper member length.

2. The modular organizer system of claim 1, further comprising:

a first sidewall perpendicular cross member, joined to the first sidewall bottom first lower member and configured to support the first sidewall upright; and a second sidewall perpendicular cross member, joined to the second sidewall bottom first lower member and configured to support the second sidewall upright.

3. The modular organizer system of claim 2, further comprising a tube member, arranged over the first sidewall perpendicular cross member and the second sidewall perpendicular cross member and connecting the first sidewall to the second sidewall.

4. The modular organizer system of claim 1, further comprising:

a first sidewall perpendicular cross tube, joined to the first sidewall bottom first lower member and configured to support the first sidewall upright; and a second sidewall perpendicular cross tube, joined to the second sidewall bottom first lower member and configured to support the second sidewall upright.

5. The modular organizer system of claim 4, further comprising a bar member, arranged into the first sidewall perpendicular cross tube and the second sidewall perpendicular cross tube and connecting the first sidewall to the second sidewall.

6. The modular organizer system of claim 1, further comprising:

a first sidewall second lower member, joined to the first plurality of upright support members and configured to further support the first sidewall; and a second sidewall second lower member, joined to the second plurality of upright support members and configured to further support the second sidewall.

7. The modular organizer system of claim 1, further comprising:

a second sidewall upper member male threaded member, arranged on a second sidewall upper member first end of the second sidewall upper member;

a second sidewall upper member female threaded cap, threaded onto the second sidewall upper member male threaded member;

wherein adjusting the second sidewall upper member female threaded cap adjusts a second sidewall upper member length.

8. The modular organizer system of claim 1, further comprising an accessory within the segregated storage space; wherein the accessory has a shape selected from one member of a shape set consisting of: a box shape, a bowl shape, a wedge shape and a knife block.

9. The modular organizer system of claim 1, further comprising an accessory within the segregated storage space; wherein the accessory further comprises a first peg and a second peg; wherein the first peg fits between the first sidewall first set of support members and the second peg fits between the second sidewall first set of support members.

10. The modular organizer system of claim 1, wherein the first sidewall further comprises a first sidewall female support tube and a first sidewall male support protrusion.

11. The modular organizer system of claim 10, further comprising a first sidewall rail extender further comprising a first sidewall rail extender support protrusion and a first sidewall rail extender female support tube; wherein the first sidewall female support tube slides over the first sidewall rail extender support protrusion to connect the first sidewall to the first sidewall rail extender.

12. The modular organizer system of claim 1, wherein the first sidewall further comprises a first sidewall upper member protrusion and a first sidewall lower member protrusion.

13. The modular organizer system of claim 12, further comprising:

a first sidewall rail extender further comprising a first sidewall rail extender upper member tube and a first sidewall rail extender lower member tube;

wherein the first sidewall rail extender lower member tube slides over the first sidewall lower member protrusion to connect the first sidewall to the first sidewall rail extender;

wherein the first sidewall rail extender upper member tube slides over the first sidewall upper member protrusion to connect the first sidewall to the first sidewall rail extender.

14. The modular organizer system of claim 1, further comprising a divider arranged between a first sidewall first set of support members and a second sidewall first set of support members.

15. The modular organizer system of claim 14, further comprising: a second divider, arranged between a first sidewall second set of support members and a second sidewall second set of support members.

16. The modular organizer system of claim 15, further comprising an accessory, arranged between the first divider and the second divider.

17. A modular organizer system, configured to sort and store items; the modular organizer system comprising:

a first rail assembly further comprising:

a first sidewall further comprising a first sidewall upper member joined to a first sidewall lower member with a first plurality of upright support members;

a second rail assembly further comprising:

a second sidewall, proximate the first sidewall and further comprising a second sidewall upper member joined to a second sidewall lower member with a second plurality of upright support members;

wherein a segregated storage space exists between the first sidewall and the second sidewall;

a first sidewall rail extender further comprising a first sidewall rail extender upper member and a first sidewall rail extender lower member;

a first sidewall upper magnet, joined to the first sidewall upper member;

a first sidewall lower magnet, joined to the first sidewall lower member;

a first sidewall rail extender upper member upper magnet, joined to the first sidewall rail extender upper member;

a first sidewall rail extender lower member lower magnet, joined to the first sidewall rail extender lower member;

wherein the first sidewall upper magnet is magnetically coupled to the first sidewall rail extender upper member upper magnet and the first sidewall lower magnet is magnetically coupled to the first sidewall rail extender lower member lower magnet to magnetically couple the first sidewall to the first sidewall rail extender.

18. A modular organizer system, configured to sort and store items; the modular organizer system comprising:

a first rail assembly further comprising:

a first sidewall further comprising a first sidewall upper member joined to a first sidewall lower member with a first plurality of upright support members;

a second rail assembly further comprising:

a second sidewall, proximate the first sidewall and further comprising a second sidewall upper member joined to a second sidewall lower member with a second plurality of upright support members;

wherein a segregated storage space exists between the first sidewall and the second sidewall;

a divider arranged between a first sidewall first set of support members and a second sidewall first set of support members;

a top side, connecting a first angled side and a second angled side;

a bottom side, connecting the first angled side and the second angled side;

a notch arranged from the first angled side to the bottom side;

a tip arranged at a corner formed by the top side and the second angled side;

wherein the first angled side is approximately parallel to the second angled side;

wherein the notch rests against the first sidewall first lower member and the tip extends beneath the second sidewall upper member.

19. The modular organizer system of claim 18, further comprising:

a third rail assembly further comprising a third sidewall, proximate the second side wall and further comprising a third sidewall upper member joined to a third sidewall lower member with a third plurality of upright support members;

a third divider, arranged between the second sidewall first set of support members and the third sidewall first set of support members;

wherein the second angled side of the first divider is immediately adjacent to the first angled side of the third divider.

* * * * *